US011802555B2

(12) United States Patent
Tanaka et al.

(10) Patent No.: US 11,802,555 B2
(45) Date of Patent: Oct. 31, 2023

(54) PIEZOELECTRIC PUMP

(71) Applicant: Murata Manufacturing Co., Ltd., Kyoto (JP)

(72) Inventors: Nobuhira Tanaka, Kyoto (JP); Masaaki Fujisaki, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 184 days.

(21) Appl. No.: 17/387,322

(22) Filed: Jul. 28, 2021

(65) Prior Publication Data

US 2021/0355930 A1 Nov. 18, 2021

Related U.S. Application Data

(63) Continuation of application No. PCT/JP2020/002390, filed on Jan. 23, 2020.

(30) Foreign Application Priority Data

Mar. 27, 2019 (JP) ..... 2019-061036

(51) Int. Cl.
*F04B 45/047* (2006.01)
*F04B 39/10* (2006.01)

(52) U.S. Cl.
CPC ..... *F04B 45/047* (2013.01); *F04B 39/1086* (2013.01)

(58) Field of Classification Search
CPC .. F04B 43/095; F04B 45/047; F04B 39/1086; F04B 53/1075
See application file for complete search history.

(56) References Cited

U.S. PATENT DOCUMENTS

| | | | | |
|---|---|---|---|---|
| 11,293,428 | B2 * | 4/2022 | Tanaka | F04B 45/047 |
| 2010/0215522 | A1 | 8/2010 | Kawamura et al. | |
| 2015/0023821 | A1 | 1/2015 | Campbell et al. | |
| 2017/0218949 | A1 | 8/2017 | Yokoi et al. | |

(Continued)

FOREIGN PATENT DOCUMENTS

| | | | |
|---|---|---|---|
| CN | 106733310 A | * | 5/2017 |
| CN | 113464410 A | * | 10/2021 |
| JP | 2009074418 A | | 4/2009 |

(Continued)

OTHER PUBLICATIONS

International Search Report issued in Application No. PCT/JP2020/002390, dated Mar. 3, 2020.

(Continued)

*Primary Examiner* — Charles G Freay
(74) *Attorney, Agent, or Firm* — Pearne & Gordon LLP

(57) ABSTRACT

A piezoelectric pump includes a first faceplate, a second faceplate, a diaphragm, a first peripheral wall, and a second peripheral wall. The diaphragm includes a vibrating portion to which a piezoelectric device is attached, a frame portion, and a connecting portion. The connecting portion defines a third opening that allows a first pump chamber and a second pump chamber to communicate with each other. The first pump chamber is provided with an annular first valve surrounding a first opening at a distance from the first opening in plan view from a major surface of the first faceplate toward a major surface of the diaphragm.

21 Claims, 15 Drawing Sheets

(56) References Cited

U.S. PATENT DOCUMENTS

2021/0010467 A1 1/2021 Fujisaki et al.

FOREIGN PATENT DOCUMENTS

| | | | |
|---|---|---|---|
| JP | 2009156454 | A | 7/2009 |
| JP | 2010223218 | A | 10/2010 |
| JP | 2019039436 | A | 3/2019 |
| WO | 2016013390 | A1 | 1/2016 |
| WO | 2019230159 | A1 | 12/2019 |
| WO | 2019230160 | A1 | 12/2019 |

OTHER PUBLICATIONS

Written Opinion issued in Application No. PCT/JP2020/002390, dated Mar. 3, 2020.

* cited by examiner

PIEZOELECTRIC PUMP

CROSS REFERENCE TO RELATED APPLICATIONS

This is a continuation of International Application No. PCT/JP2020/002390 filed on Jan. 23, 2020 which claims priority from Japanese Patent Application No. 2019-061036 filed on Mar. 27, 2019. The contents of these applications are incorporated herein by reference in their entireties.

BACKGROUND OF THE DISCLOSURE

Field of the Disclosure

The present disclosure relates to a piezoelectric pump.

Description of the Related Art

Hitherto, piezoelectric pumps including piezoelectric devices have been disclosed (see Patent Document 1, for example).

A piezoelectric pump disclosed in Patent Document 1 includes a diaphragm to which a piezoelectric device is pasted, a first faceplate and a second faceplate each facing a corresponding one of two major surfaces of the diaphragm, and a first peripheral wall and a second peripheral wall. The first peripheral wall connects the diaphragm and the first faceplate to each other. The second peripheral wall connects the diaphragm and the second faceplate to each other. A space enclosed by the first faceplate, the diaphragm, and the first peripheral wall serves as a first pump chamber. A space enclosed by the second faceplate, the diaphragm, and the second peripheral wall serves as a second pump chamber. The two pump chambers are separated from each other by the diaphragm.

The first faceplate has an inlet and an outlet. The second faceplate also has an inlet and an outlet. Each of the outlets includes a plurality of openings and is selectively opened or closed by a film-type valve provided in a corresponding one of the pump chambers.

In such a configuration, when alternating electric power is supplied to the piezoelectric device, the piezoelectric device undergoes bending deformation in a unimorphic mode, which changes the pressures in the spaces as the first pump chamber and the second pump chamber. The valves provided in the pump chambers each reciprocate between a position for opening the outlet and a position for closing the outlet in accordance with the pressure change.

Patent Document 1: U.S. Patent Application Publication No. 2015/0023821

BRIEF SUMMARY OF THE DISCLOSURE

The valve that opens or closes the outlet repeatedly collides with the edge of the outlet. The valve repeatedly colliding with the edge of the outlet may be damaged. Such damage may deteriorate the function as a valve. Consequently, the reliability of the piezoelectric pump may be reduced.

Accordingly, it is an object of the present disclosure to solve the above problem and to provide a piezoelectric pump with increased reliability.

To achieve the above object, a piezoelectric pump according to the present disclosure includes a first faceplate having a first opening, a second faceplate spaced apart from the first faceplate and having a second opening, a diaphragm provided between the first faceplate and the second faceplate and to which a piezoelectric device is attached, a first peripheral wall that connects the first faceplate and the diaphragm to each other and defines a first pump chamber provided between the first faceplate and the diaphragm, and a second peripheral wall that connects the second faceplate and the diaphragm to each other and defines a second pump chamber provided between the second faceplate and the diaphragm. The diaphragm includes a vibrating portion to which the piezoelectric device is attached, a frame portion held between the first peripheral wall and the second peripheral wall, and a connecting portion connecting the vibrating portion and the frame portion to each other. The connecting portion defines a third opening that allows the first pump chamber and the second pump chamber to communicate with each other. The first pump chamber is provided with an annular first valve surrounding the first opening at a distance from the first opening in plan view from a major surface of the first faceplate toward a major surface of the diaphragm.

The piezoelectric pump according to the present disclosure can provide increased reliability.

DETAILED DESCRIPTION OF THE DISCLOSURE

Figure 1:
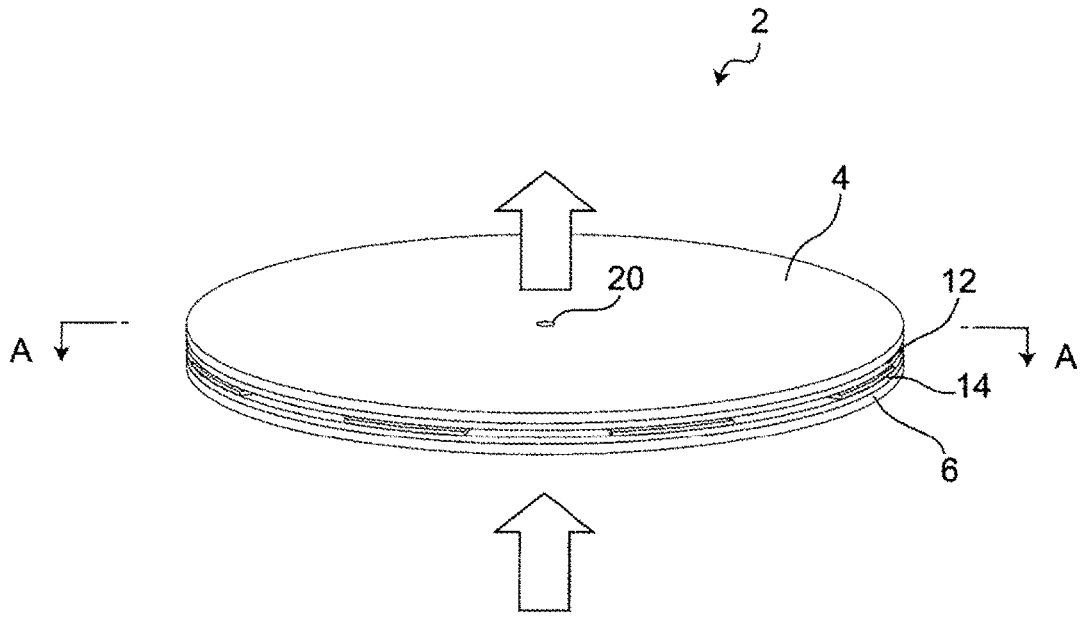
FIG. 1 is a perspective view of a piezoelectric pump according to Embodiment 1.

According to a first embodiment of the present disclosure, there is provided a piezoelectric pump including a first faceplate having a first opening, a second faceplate spaced apart from the first faceplate and having a second opening, a diaphragm provided between the first faceplate and the second faceplate and to which a piezoelectric device is attached, a first peripheral wall that connects the first faceplate and the diaphragm to each other and defines a first pump chamber provided between the first faceplate and the diaphragm, and a second peripheral wall that connects the second faceplate and the diaphragm to each other and defines a second pump chamber provided between the second faceplate and the diaphragm. The diaphragm includes a vibrating portion to which the piezoelectric device is attached, a frame portion held between the first peripheral wall and the second peripheral wall, and a connecting portion connecting the vibrating portion and the frame portion to each other. The connecting portion defines a third opening that allows the first pump chamber and the second pump chamber to communicate with each other. The first pump chamber is provided with an annular first valve surrounding the first opening at a distance from the first opening in plan view from a major surface of the first faceplate toward a major surface of the diaphragm.

In such a configuration, since the first valve is spaced apart from the first opening, the first valve does not collide with the edge of the first opening. Therefore, the occurrence of the damage to the first valve can be suppressed. Consequently, the life of the first valve can be extended, whereby the reliability of the piezoelectric pump can be increased.

According to a second embodiment of the present disclosure, the piezoelectric pump according to the first embodiment is provided as follows. The second pump chamber is provided with an annular second valve surrounding the second opening at a distance from the second opening in plan view from a major surface of the second faceplate toward a major surface of the diaphragm. Furthermore, the first valve suppresses an air current flowing in an inward or outward direction in plan view from the major surface of the first faceplate toward the major surface of the diaphragm, and the second valve suppresses an air current flowing in a direction opposite to the direction of the air current suppressed by the first valve in plan view from the major surface of the second faceplate toward the major surface of the diaphragm. In such a configuration, since the second valve is spaced apart from the second opening, the second valve does not collide with the edge of the second opening. Therefore, the occurrence of the damage to the second valve can be suppressed. Consequently, the life of the second valve can be extended, whereby the reliability of the piezoelectric pump can be increased.

According to a third embodiment of the present disclosure, the piezoelectric pump according to the second embodiment is provided as follows. The first valve includes a first fixed portion fixed to the first faceplate, and a first movable portion extending from the first fixed portion. Furthermore, the second valve includes a second fixed portion fixed to the second faceplate, and a second movable portion extending from the second fixed portion. In such a configuration, since the valves are fixed to the respective faceplates, the vibrations of the fixed portions of the valves can be made smaller than in a case where the valves are fixed to the vibrating portion. Therefore, the occurrence of excessive vibration loss is suppressed, whereby a significant vibration displacement can be generated. Consequently, a high flow rate and improved pressure characteristics can be achieved.

According to a fourth embodiment of the present disclosure, the piezoelectric pump according to the second embodiment is provided as follows. The first valve includes a third fixed portion fixed to the vibrating portion, and a third movable portion extending from the third fixed portion. Furthermore, the second valve includes a fourth fixed portion fixed to the vibrating portion, and a fourth movable portion extending from the fourth fixed portion. In such a configuration, since the valves are fixed to the vibrating portion, the flow-path resistance in areas near the respective faceplates can be reduced. Consequently, a high flow rate can be achieved.

According to a fifth embodiment of the present disclosure, the piezoelectric pump according to the third embodiment is provided as follows. The first movable portion of the first valve is positioned on an inner side with respect to the first fixed portion of the first valve in plan view from the major surface of the first faceplate toward the major surface of the diaphragm. Furthermore, the second movable portion of the second valve is positioned on an outer side with respect to the second fixed portion of the second valve in plan view from the major surface of the second faceplate toward the major surface of the diaphragm. In such a configuration, an air current that flows from the outside of the piezoelectric pump through the second opening into the second pump chamber, further flows through the third opening into the first pump chamber, and is discharged through the first opening to the outside can be promoted.

According to a sixth embodiment of the present disclosure, the piezoelectric pump according to the fourth embodiment is provided as follows. The third movable portion of the first valve is positioned on an inner side with respect to the third fixed portion of the first valve in plan view from the major surface of the first faceplate toward the major surface of the diaphragm. Furthermore, the fourth movable portion of the second valve is positioned on an outer side with respect to the fourth fixed portion of the second valve in plan view from the major surface of the second faceplate toward the major surface of the diaphragm. In such a configuration, an air current that flows from the outside of the piezoelectric pump through the second opening into the second pump chamber, further flows through the third opening into the first pump chamber, and is discharged through the first opening to the outside can be promoted.

According to a seventh embodiment of the present disclosure, the piezoelectric pump according to the third embodiment is provided as follows. The first movable portion of the first valve is positioned on an outer side with respect to the first fixed portion of the first valve in plan view from the major surface of the first faceplate toward the major surface of the diaphragm. Furthermore, the second movable portion of the second valve is positioned on an inner side with respect to the second fixed portion of the second valve in plan view from the major surface of the second faceplate toward the major surface of the diaphragm. In such a configuration, an air current that flows from the outside of the piezoelectric pump through the first opening into the first pump chamber, further flows through the third opening into the second pump chamber, and is discharged through the second opening to the outside can be promoted.

According to an eighth embodiment of the present disclosure, the piezoelectric pump according to the fourth embodiment is provided as follows. The third movable portion of the first valve is positioned on an outer side with respect to the third fixed portion of the first valve in plan view from the major surface of the first faceplate toward the major surface of the diaphragm. Furthermore, the fourth movable portion of the second valve is positioned on an inner side with respect to the fourth fixed portion of the second valve in plan view from the major surface of the second faceplate toward the major surface of the diaphragm. In such a configuration, an air current that flows from the outside of the piezoelectric pump through the first opening into the first pump chamber, further flows through the third opening into the second pump chamber, and is discharged through the second opening to the outside can be promoted.

According to a ninth embodiment of the present disclosure, the piezoelectric pump according to any of the first to eighth embodiments is provided as follows. An outer edge of the vibrating portion is positioned apart from a vibration node of the vibrating portion. In such a configuration, since the outer edge of the vibrating portion is vibrated assuredly, the transmission of the vibration from the piezoelectric device to the peripheral walls and the faceplates that form an outer shell of the piezoelectric pump can be suppressed. Thus, the leakage of the vibration can be reduced. Consequently, the displacement of the vibrating portion can be increased.

According to a tenth embodiment of the present disclosure, the piezoelectric pump according to any of the first to ninth embodiments is provided as follows. The vibrating portion, the connecting portion, and the frame portion are integrated altogether. In such a configuration, the leakage of the vibration can be reduced.

According to an eleventh embodiment of the present disclosure, the piezoelectric pump according to any of the first to ninth embodiments is provided as follows. The vibrating portion and the connecting portion are separate from each other. Furthermore, the connecting portion is made of a material having an elastic modulus lower than an elastic modulus of the vibrating portion. In such a configuration, the leakage of the vibration can be reduced.

According to a twelfth embodiment of the present disclosure, the piezoelectric pump according to the eleventh embodiment is provided as follows. The connecting portion is thinner than the vibrating portion. In such a configuration, the leakage of the vibration can be reduced.

According to a thirteenth embodiment of the present disclosure, the piezoelectric pump according to any of the first to twelfth embodiments is provided as follows. The connecting portion includes a first connecting part extending outward from an outer edge of the vibrating portion, a second connecting part extending from the first connecting part and along the outer edge of the vibrating portion, and a third connecting part extending from the second connecting part and connected to the frame portion. In such a configuration, the leakage of the vibration can be reduced.

Now, such embodiments of the present disclosure will be described in detail with reference to the drawings.

Embodiment 1

Figure 2:
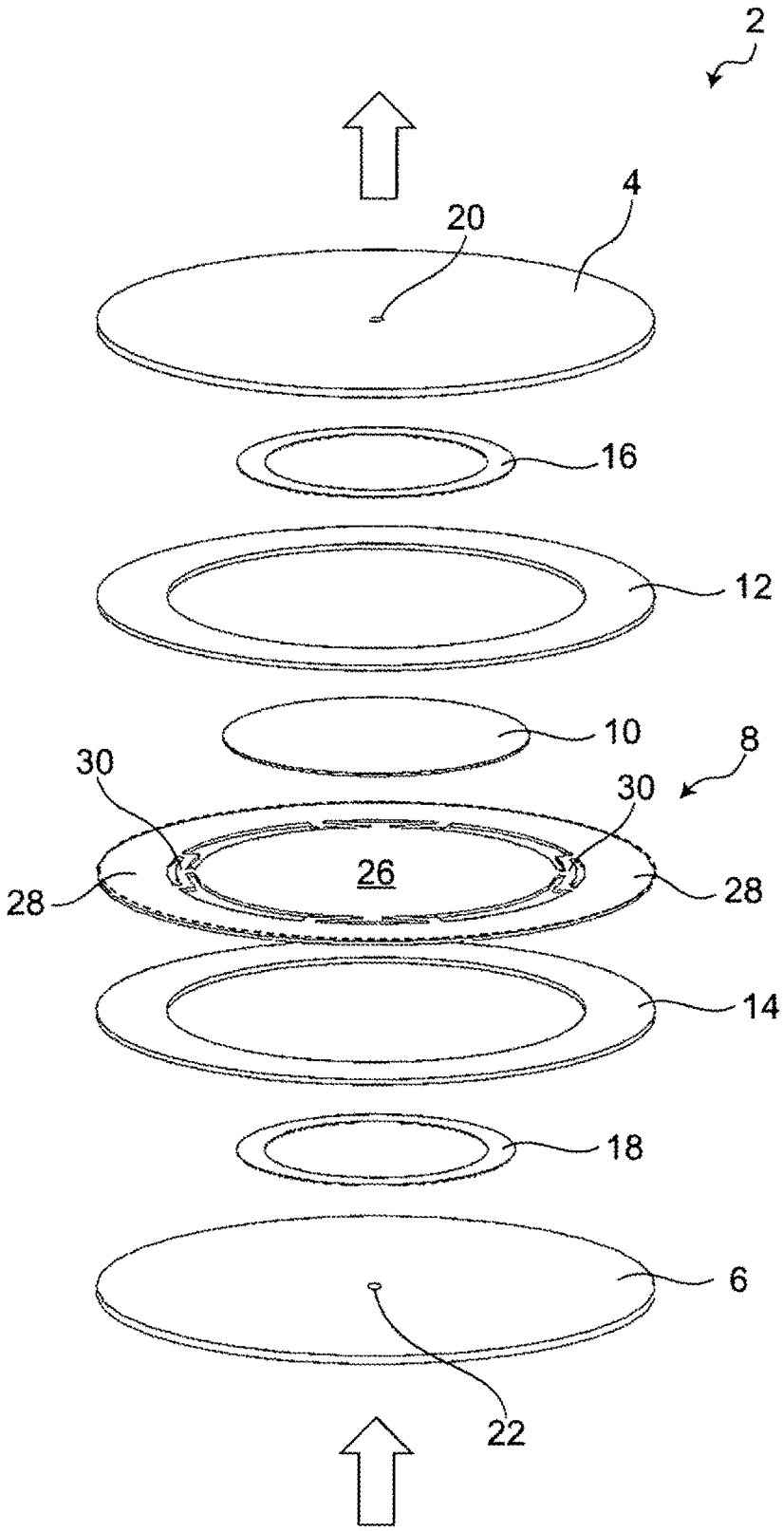
FIG. 2 is an exploded perspective view of the piezoelectric pump according to Embodiment 1.
Figure 3:
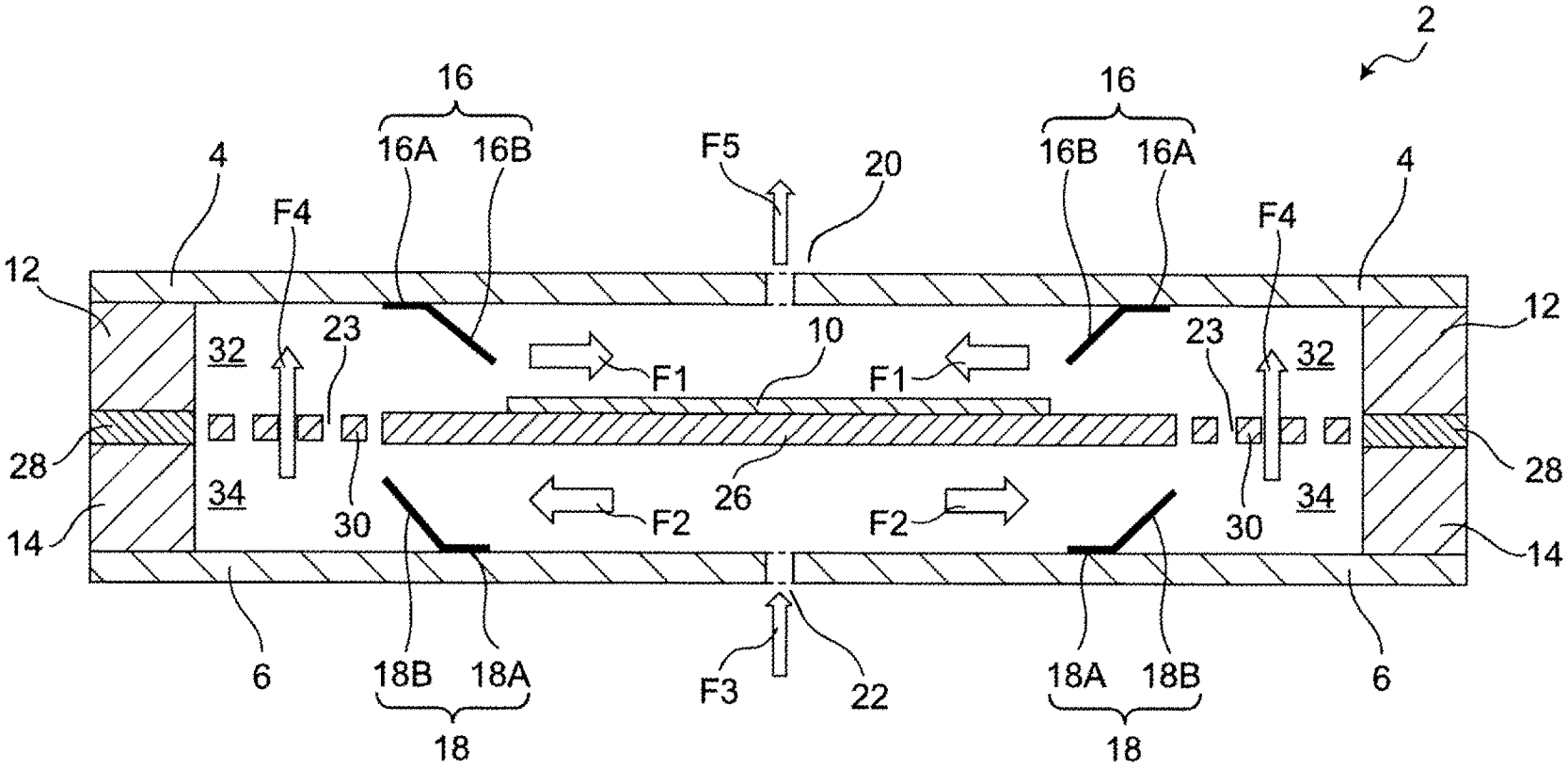
FIG. 3 is a sectional view taken along line A-A illustrated in FIG. 1.

FIGS. 1 to 3 illustrate a schematic configuration of a piezoelectric pump 2 according to Embodiment 1. FIG. 1 is a perspective view of the piezoelectric pump 2 according to Embodiment 1. FIG. 2 is an exploded perspective view of the piezoelectric pump 2. FIG. 3 is a vertical sectional view (a sectional view taken along line A-A in FIG. 1) of the piezoelectric pump 2.

The piezoelectric pump 2 is a pump apparatus that transports air by using a piezoelectric device 10 (see FIGS. 2 and 3) (the piezoelectric pump 2 may also be referred to as "microblower", "micropump", or the like). The piezoelectric pump 2 suctions air through a second opening 22 as an inlet and discharges air through a first opening 20 as an outlet while the piezoelectric device 10 is vibrated at a high speed. As illustrated in FIGS. 1 to 3, the first opening 20 is provided in the front face of the piezoelectric pump 2, and the second opening 22 is provided in the back face of the piezoelectric pump 2.

As illustrated in FIGS. 2 and 3, the piezoelectric pump 2 includes a first faceplate 4, a second faceplate 6, a diaphragm 8, the piezoelectric device 10, a first peripheral wall 12, a second peripheral wall 14, a first valve 16, and a second valve 18. The piezoelectric pump 2 has a structure in which the piezoelectric device 10 is pasted to the diaphragm 8. When alternating electric power is supplied to the piezoelectric device 10, the piezoelectric device 10 undergoes bending deformation in a unimorphic mode. The piezoelectric pump 2 includes therein the first valve 16 and the second valve 18.

The first faceplate 4 and the second faceplate 6 form the front face and the back face, respectively, of the piezoelectric pump 2. The first faceplate 4 and the second faceplate 6 are each a disc-like member and are spaced apart from each other. The first opening 20 is provided in a central part of the first faceplate 4. The second opening 22 is provided in a central part of the second faceplate 6. No other openings are provided in the first faceplate 4 and the second faceplate 6. The first faceplate 4 and the second faceplate 6 are made of, for example, metal such as stainless steel or aluminum, or resin such as PPS (polyphenylene sulfide).

The diaphragm 8 is provided between the first faceplate 4 and the second faceplate 6. The diaphragm 8 carries the piezoelectric device 10. Alternatively, the diaphragm 8 may include the piezoelectric device 10. The diaphragm 8 includes a vibrating portion 26, a frame portion 28, and connecting portions 30. Details of the diaphragm 8 will be described separately below.

As illustrated in FIG. 3, the piezoelectric device 10 overlaps the first opening 20 and a part of the first faceplate 4 around the first opening 20 in plan view. The piezoelectric device 10 further overlaps the second opening 22 and a part of the second faceplate 6 around the second opening 22 in plan view.

The first peripheral wall 12 and the second peripheral wall 14 each form a part of the peripheral wall of the piezoelectric pump 2. The first peripheral wall 12 and the second peripheral wall 14 are each an annular member having a circular opening in a central part thereof. The first peripheral wall 12 and the second peripheral wall 14 are made of, for example, metal or resin.

As illustrated in FIG. 3, the first peripheral wall 12 connects the first faceplate 4 and the diaphragm 8 to each other and defines a first pump chamber 32 provided between the first faceplate 4 and the diaphragm 8. The second peripheral wall 14 connects the second faceplate 6 and the diaphragm 8 to each other and defines a second pump chamber 34 provided between the second faceplate 6 and the diaphragm 8.

The first pump chamber 32 and the second pump chamber 34 communicate with each other through third openings 23 illustrated in FIG. 3. The third openings 23 are defined by the connecting portions 30 of the diaphragm 8 described above.

The first valve 16 and the second valve 18 control the flow of the air generated inside the piezoelectric pump 2. The first valve 16 and the second valve 18 are each an annular member having a circular opening in a central part thereof. The first valve 16 is provided in the first pump chamber 32. The second valve 18 is provided in the second pump chamber 34. The first valve 16 and the second valve 18 are made of, for example, resin such as polyimide, PET, or PPS.

As illustrated in FIG. 3, the first valve 16 includes a fixed portion (first fixed portion) 16A and a movable portion (first movable portion) 16B. The fixed portion 16A is fixed to the first faceplate 4. The movable portion 16B extends from the fixed portion 16A. The movable portion 16B is not fixed to any member and serves as a free end (an unfixed end).

As illustrated in FIG. 3, the movable portion 16B is positioned on the center side, that is, nearer to the first opening 20 than the fixed portion 16A is. In the first pump chamber 32 with such an arrangement, a current of the air flowing from the center toward the outer side is suppressed, whereas a current F1 flowing in the opposite direction from the outer side toward the center is promoted.

The second valve 18 includes a fixed portion (second fixed portion) 18A and a movable portion (second movable portion) 18B. The fixed portion 18A is fixed to the second faceplate 6. The movable portion 18B extends from the fixed portion 18A. The movable portion 18B is not fixed to any member and serves as a free end.

The movable portion 18B is positioned on the outer side, that is, farther from the second opening 22 than the fixed portion 18A is. In the second pump chamber 34 with such an arrangement, a current of the air flowing from the outer side toward the center is suppressed, whereas a current F2 flowing in the opposite direction from the center toward the outer side is promoted.

Figure 4A:
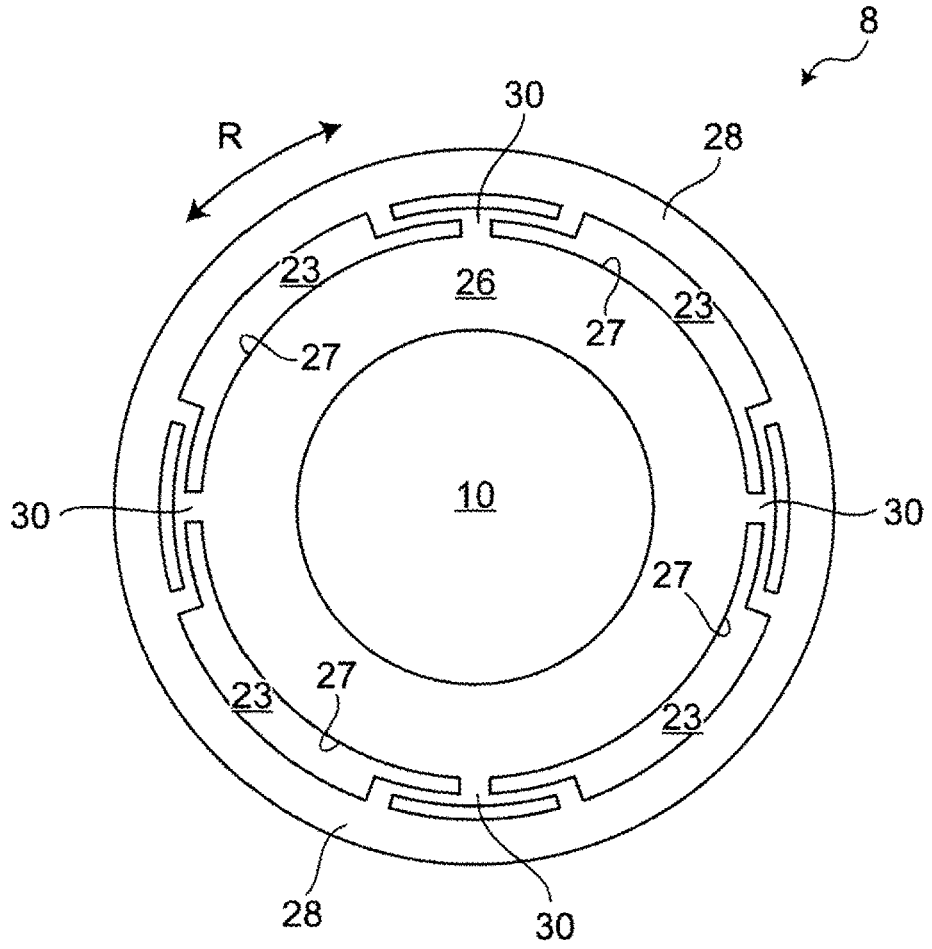
FIG. 4A is a plan view of a diaphragm according to Embodiment 1.
Figure 4B:
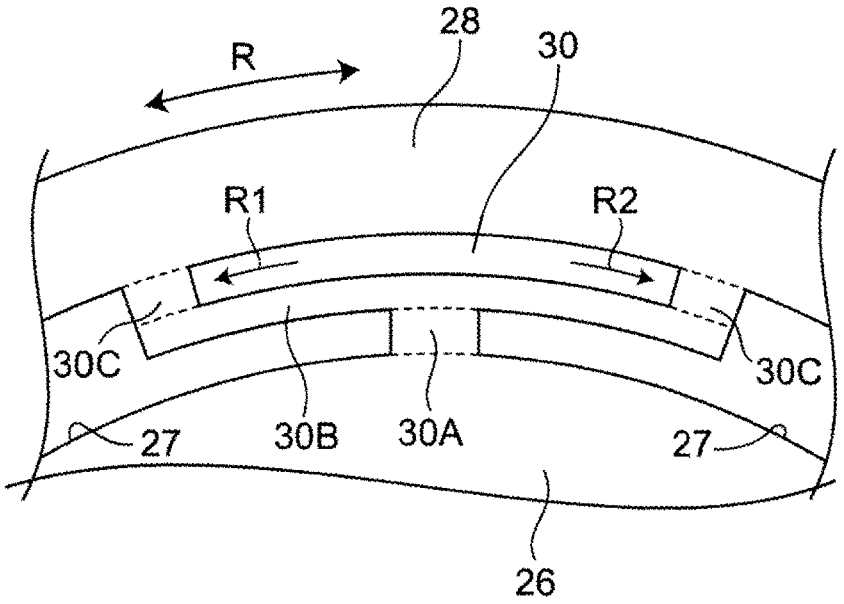
FIG. 4B is an enlargement of part of FIG. 4A.

Now, a configuration of the diaphragm 8 will be described with reference to FIGS. 4A and 4B. FIG. 4A is a plan view of the diaphragm 8, to which the piezoelectric device 10 is attached. FIG. 4B is an enlargement of part of FIG. 4A.

As illustrated in FIG. 4A, the diaphragm 8 according to Embodiment 1 includes the vibrating portion 26, the frame portion 28, and the plurality of connecting portions 30, which are integrated altogether. The diaphragm 8 is chiefly made of, for example, metal such as stainless steel or aluminum. The entirety or a part of the surface of the diaphragm 8 may be coated with an insulating material such as polyimide.

The vibrating portion 26 is a disc-like part to which the piezoelectric device 10 is attached. The vibrating portion 26 serves as a vibrating member that vibrates together with the piezoelectric device 10. The piezoelectric device 10 attached to the vibrating portion 26 is positioned concentrically with the vibrating portion 26.

The frame portion 28 forms an outer peripheral part of the diaphragm 8. The frame portion 28 is held between the first peripheral wall 12 and the second peripheral wall 14 described above. The frame portion 28 in combination with the first peripheral wall 12 and the second peripheral wall 14 forms the peripheral wall of the piezoelectric pump 2. The frame portion 28 according to Embodiment 1 extends continuously over the entirety of the diaphragm 8 in a circumferential direction R.

The connecting portions 30 connect the vibrating portion 26 and the frame portion 28 to each other. The connecting portions 30 each extend from an outer edge 27 of the vibrating portion 26 toward the outer side and are connected to the frame portion 28. The connecting portions 30 serve as supporting portions that support the vibrating portion 26. The connecting portions 30 are provided at a plurality of separate positions, respectively. The plurality of third openings 23 are each defined between adjacent ones of the connecting portions 30.

As described above with reference to FIG. 3, the third openings 23 allow the first pump chamber 32 and the second pump chamber 34 to communicate with each other. The frame portion 28, which adjoins the third openings 23, extends continuously over the entire circumference of the diaphragm 8, as described above. Therefore, the third openings 23 are not exposed to the outside of the piezoelectric pump 2. In such a configuration, not only the current F1 in the first pump chamber 32 and the current F2 in the second pump chamber 34 described above but also currents F3 to F5 illustrated in FIG. 3 are generated in accordance with the pressure change caused by the vibration of the piezoelectric device 10. The current F3 flows through the second opening 22 into the second pump chamber 34. The current F4 flows from the second pump chamber 34 through the third openings 23 into the first pump chamber 32. The current F5 flows from the first pump chamber 32 through the first opening 20 to the outside. In FIG. 3, the average currents generated in the piezoelectric pump 2 are represented by arrows F1 to F5.

Now, the connecting portions 30 will be described in detail with reference to FIG. 4B.

As illustrated in FIG. 4B, the connecting portions 30 each include a first connecting part 30A, a second connecting part 30B, and third connecting parts 30C. The first connecting part 30A extends outward from the outer edge 27 of the vibrating portion 26. The second connecting part 30B extends from the distal end of the first connecting part 30A and along the outer edge 27 of the vibrating portion 26. The second connecting part 30B illustrated in FIG. 4B includes a segment R1 extending toward one side along the outer edge 27 of the vibrating portion 26, and a segment R2 extending toward the other side. The third connecting parts 30C extend from two respective ends of the second connecting part 30B to the frame portion 28.

In such a configuration, the connecting portions 30 including the second connecting parts 30B serve as beams that support the vibrating portion 26. The connecting portions 30 serving as beams can be provided with desired flexibility. Therefore, even when the vibrating portion 26 vibrates, the transmission of the vibration of the vibrating portion 26 through the connecting portions 30 to the frame portion 28 is suppressed. Thus, the leakage of the vibration of the piezoelectric device 10 can be reduced.

Figure 5A:
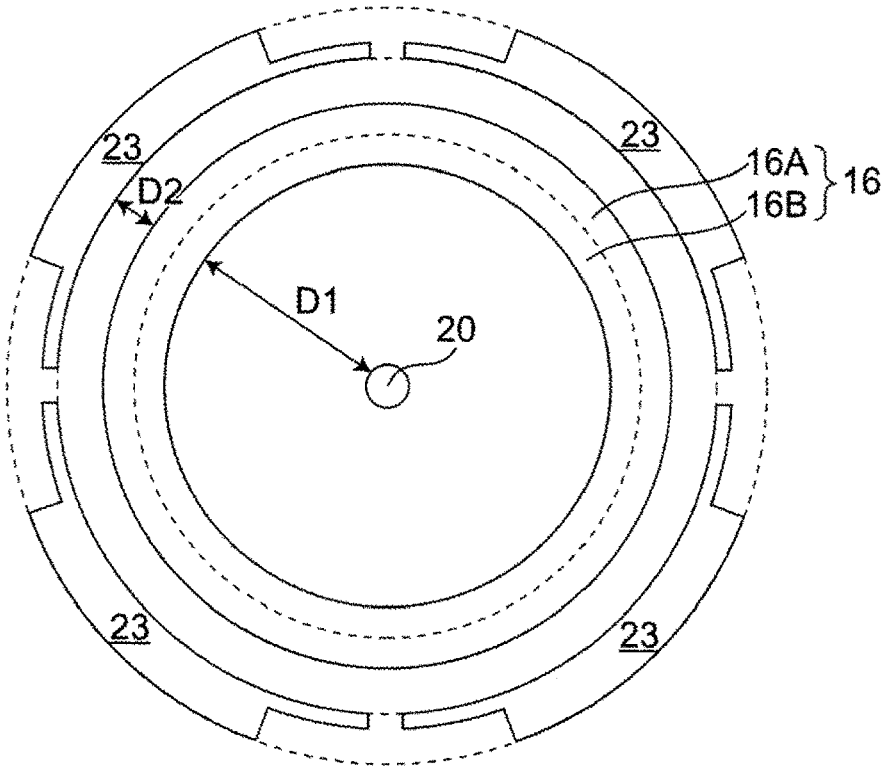
FIG. 5A is a plan view of the piezoelectric pump according to Embodiment 1 and illustrates the positional relationship between a first opening, a first valve, and third openings.
Figure 5B:
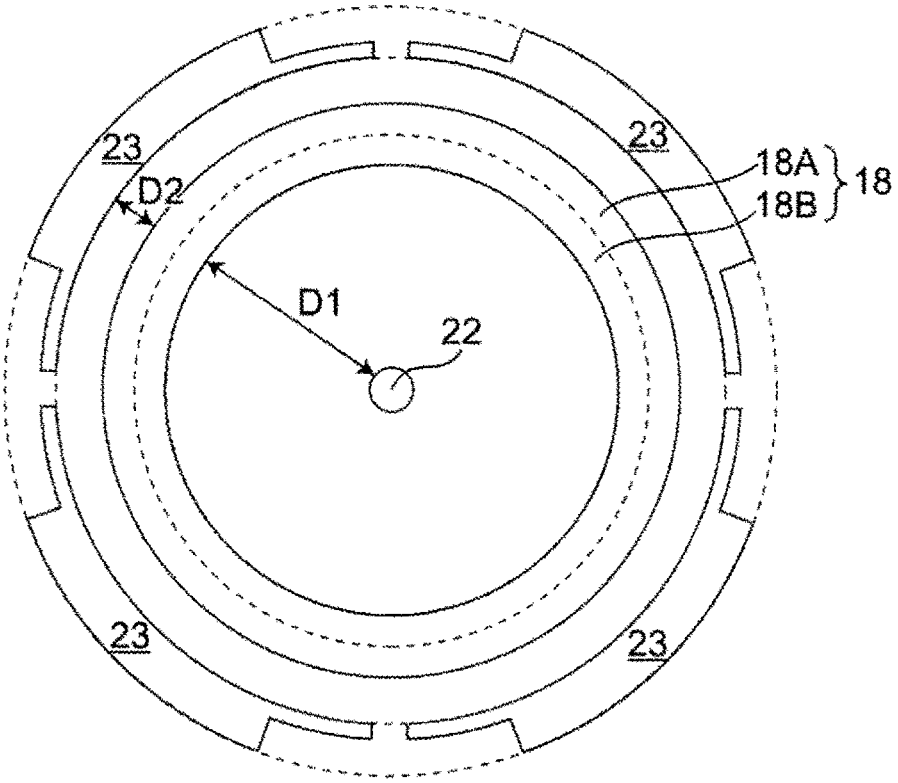
FIG. 5B is a plan view of the piezoelectric pump according to Embodiment 1 and illustrates the positional relationship between a second opening, a second valve, and the third openings.

Now, the relationship between each of the valves 16 and 18 and a corresponding one of the openings 20 and 22 will be described with reference to FIGS. 5A and 5B. FIG. 5A is a plan view of the piezoelectric pump 2 and illustrates the positional relationship between the first opening 20, the first valve 16, and the third openings 23. FIG. 5B is a plan view of the piezoelectric pump 2 and illustrates the positional relationship between the second opening 22, the second valve 18, and the third openings 23.

As illustrated in FIG. 5A, the first opening 20 is positioned on the inner side with respect to the first valve 16 in plan view, and the third openings 23 are positioned on the outer side with respect to the first valve 16 in plan view. The first valve 16 has an annular shape surrounding the first opening 20 at a distance D1 therefrom. Furthermore, the first valve 16 is at a distance D2 from the third openings 23. In such a configuration, since the first valve 16 is spaced apart from the first opening 20, even when the movable portion 16B of the first valve 16 moves at a high speed with the activation of the piezoelectric pump 2, the movable portion 16B does not collide with the edge of the first opening 20. Such a design that avoids the collision of the movable portion 16B of the first valve 16 with the edge of the first opening 20 can suppress the occurrence of the damage to the first valve 16 and can therefore extend the life of the first valve 16. Consequently, the reliability of the piezoelectric pump 2 can be increased.

Likewise, as illustrated in FIG. 5B, the second opening 22 is positioned on the inner side with respect to the second valve 18 in plan view, and the third openings 23 are positioned on the outer side with respect to the second valve 18 in plan view. The second valve 18 has an annular shape surrounding the second opening 22 at the distance D1 therefrom. Furthermore, the second valve 18 is at the distance D2 from the third openings 23. Such a configuration provides, as with the case of the first valve 16, a design that avoids the collision of the movable portion 18B of the second valve 18 with the edge of the second opening 22. Therefore, the occurrence of the damage to the second valve 18 can be suppressed, whereby the life of the second valve 18 can be extended. Consequently, the reliability of the piezoelectric pump 2 can be increased.

Figure 6:
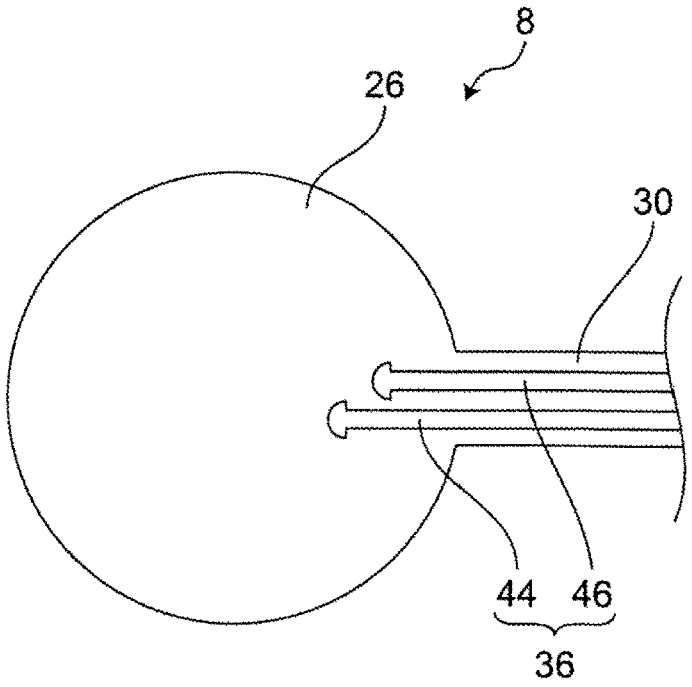
FIG. 6 is a plan view of the front face of the diaphragm according to Embodiment 1.
Figure 7:
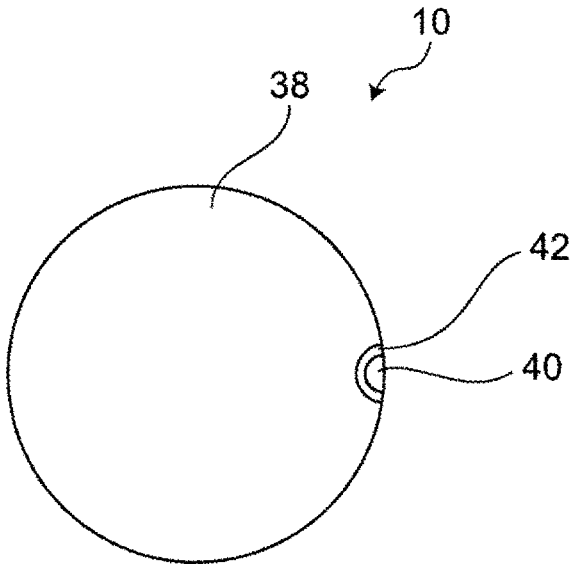
FIG. 7 is a plan view of the back face of a piezoelectric device according to Embodiment 1.

Now, wires 36 connected to the piezoelectric device 10 will be described with reference to FIGS. 6 and 7. FIG. 6 is a plan view of the front face of the diaphragm 8 on which the wires 36 are provided. FIG. 7 is a plan view of the back face of the piezoelectric device 10.

As illustrated in FIG. 6, the wires 36, namely a first wire 44 and a second wire 46, are provided on the front face of the diaphragm 8. A part of the front face of the diaphragm 8 is coated with an insulating material. Therefore, the first wire 44 and the second wire 46 provided on the diaphragm 8 are electrically insulated. Since the first wire 44 and the second wire 46 are provided on the diaphragm 8 coated with the insulating material, the risk of the breakage of the wires 44 and 46 can be reduced.

The first wire 44 and the second wire 46 extend over an area of the diaphragm 8 including a part of the vibrating portion 26, one of the connecting portions 30, and a part of the frame portion 28 and are connected to a driving circuit (not illustrated) provided outside the piezoelectric pump 2.

Areas, not illustrated, where the first wire 44 and the second wire 46 are in contact with the first peripheral wall 12 is coated with an insulating material so that the wires 44 and 46 are not electrically connected to the peripheral walls 12 and 14.

As illustrated in FIG. 7, a first electrode 38 and a second electrode 40 are provided on the back face of the piezoelectric device 10. An insulating area 42 is provided between the first electrode 38 and the second electrode 40, whereby the first electrode 38 and the second electrode 40 are electrically insulated from each other. The first electrode 38 spreads over most part of the back face of the piezoelectric device 10. The second electrode 40 is present in only a small part of the back face of the piezoelectric device 10. Instead, the second electrode 40 spreads over the entirety of the front face (not illustrated) of the piezoelectric device 10. In FIG. 7, a part of the second electrode 40 that is folded over the back face of the piezoelectric device 10 is illustrated.

The back face of the piezoelectric device 10 illustrated in FIG. 7 is brought into contact with the vibrating portion 26 of the diaphragm 8 illustrated in FIG. 6 such that the first electrode 38 is brought into contact with the first wire 44 while the second electrode 40 is brought into contact with the second wire 46. The two kinds of wires, namely the first wire 44 and the second wire 46, allow alternating electric power to be supplied to the first electrode 38 and the second electrode 40, respectively, whereby the piezoelectric device 10 can be made to undergo a desired bending motion.

Now, how the piezoelectric pump 2 configured as above works will be described with reference to FIGS. 8A to 8D. FIGS. 8A to 8D are vertical sectional views of the piezoelectric pump 2 in different states of operation thereof. In FIGS. 8A to 8D, the piezoelectric device 10 attached to the vibrating portion 26 is not illustrated.

Figure 8A:
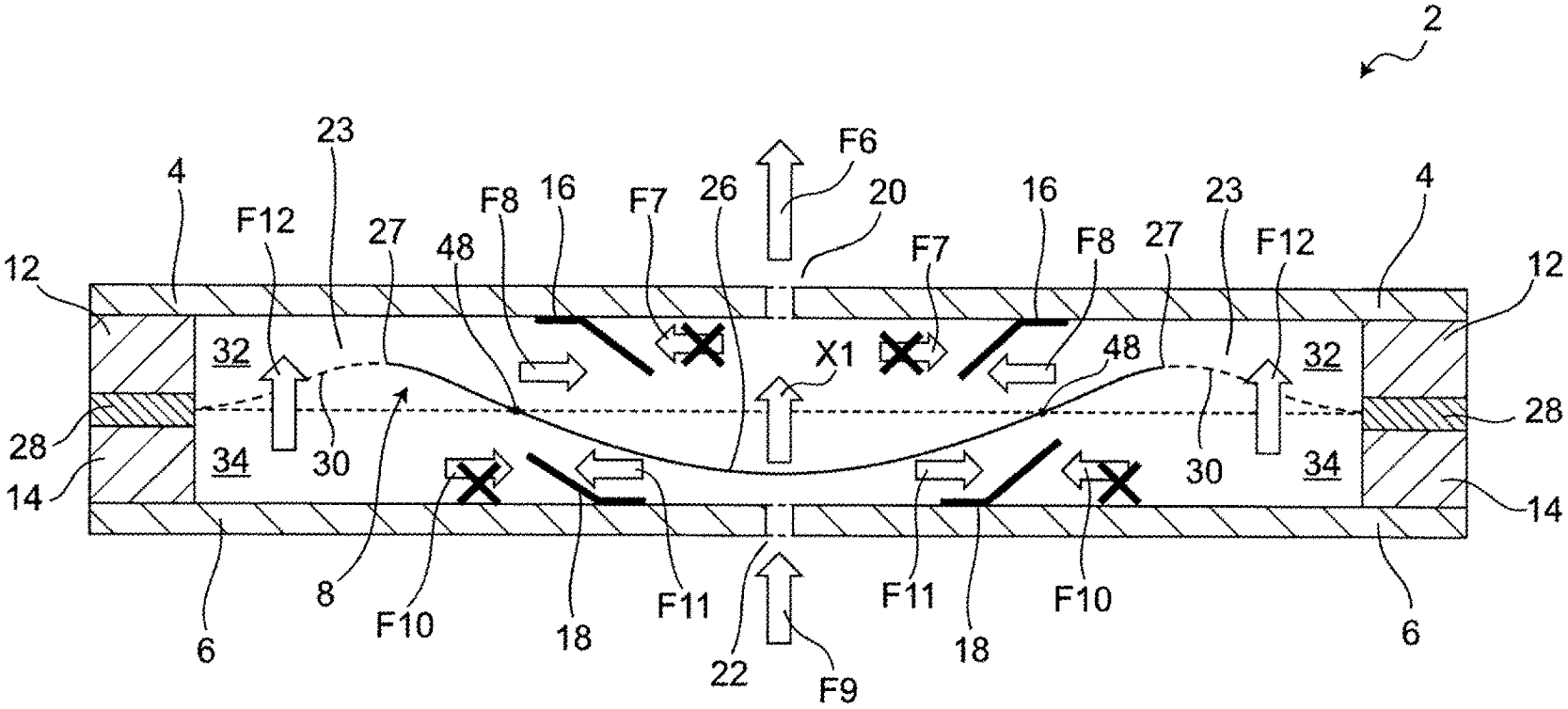
FIG. 8A is a sectional view of the piezoelectric pump according to Embodiment 1 and illustrates a state of operation thereof.
Figure 8B:
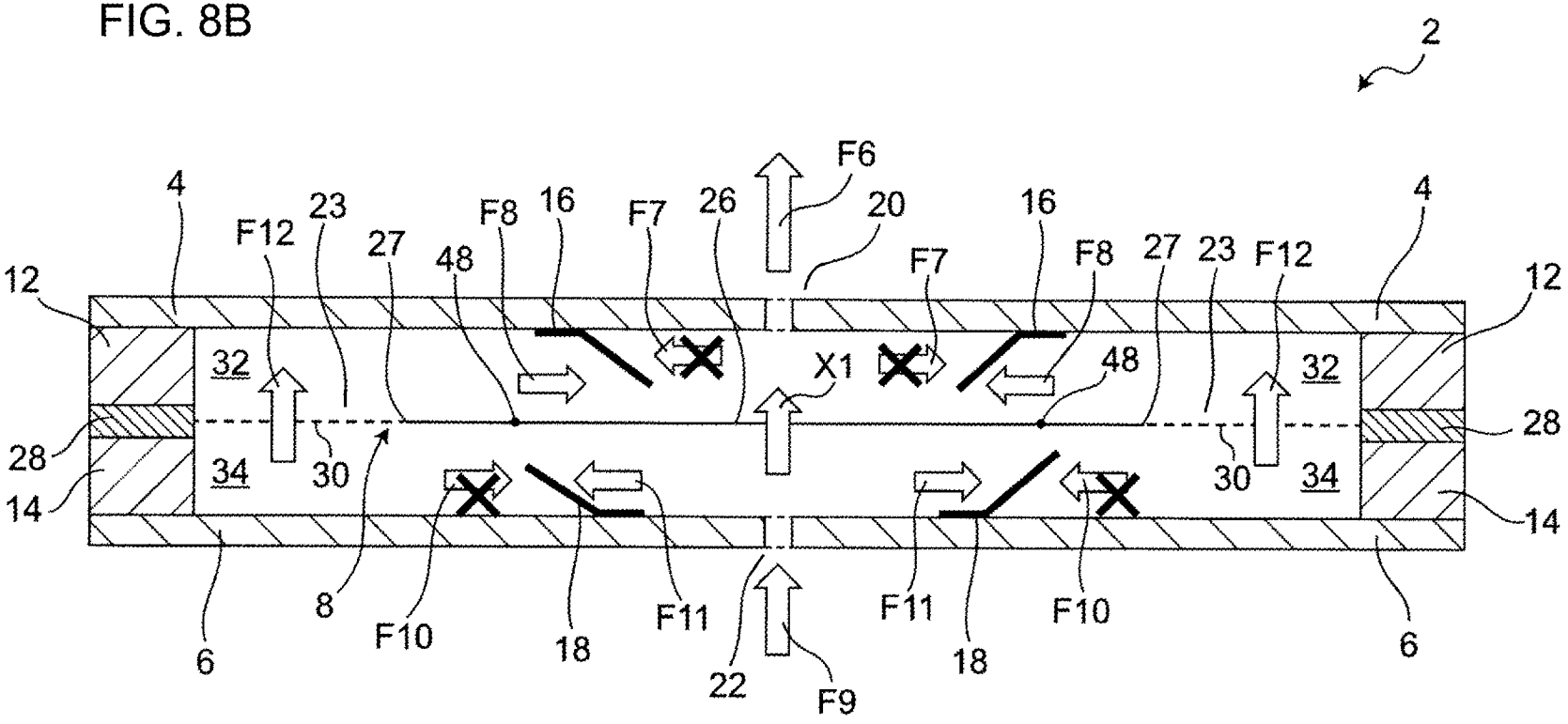
FIG. 8B is a sectional view of the piezoelectric pump according to Embodiment 1 and illustrates another state of operation thereof.

FIG. 8A illustrates a state where a central part of the diaphragm 8 is bent most significantly toward the second faceplate 6. FIG. 8B illustrates a state where the central part of the diaphragm 8 that has been in the state illustrated in FIG. 8A has moved toward the first faceplate 4 to become flat.

As illustrated in FIGS. 8A and 8B, when the central part of the diaphragm 8 that has been bent toward the second faceplate 6 moves toward the first faceplate 4 (see arrow X1), the air in a central area of the first pump chamber 32 is pushed toward the first faceplate 4, whereby a current F6 discharged through the first opening 20 is generated. Meanwhile, a current F7 flowing from the central area toward an outer area in the first pump chamber 32 is suppressed by the first valve 16. However, the first valve 16 does not suppress a current F8 flowing in the opposite direction in the first pump chamber 32 from the outer area toward the central area.

In the second pump chamber 34, a central area is expanded upward, whereby a negative pressure is generated. Therefore, a current F9 flowing from the outside of the piezoelectric pump 2 through the second opening 22 into the second pump chamber 34 is generated. Meanwhile, a current F10 flowing from an outer area toward the central area in the second pump chamber 34 is suppressed by the second valve 18. However, the second valve 18 does not suppress a current F11 flowing in the second pump chamber 34 from the central area toward the outer area.

Since the currents F8 and F11 generated in the first pump chamber 32 and the second pump chamber 34, respectively, are promoted, a current F12 flowing from the second pump chamber 34 through the third openings 23 into the first pump chamber 32 is generated.

Figure 8C:
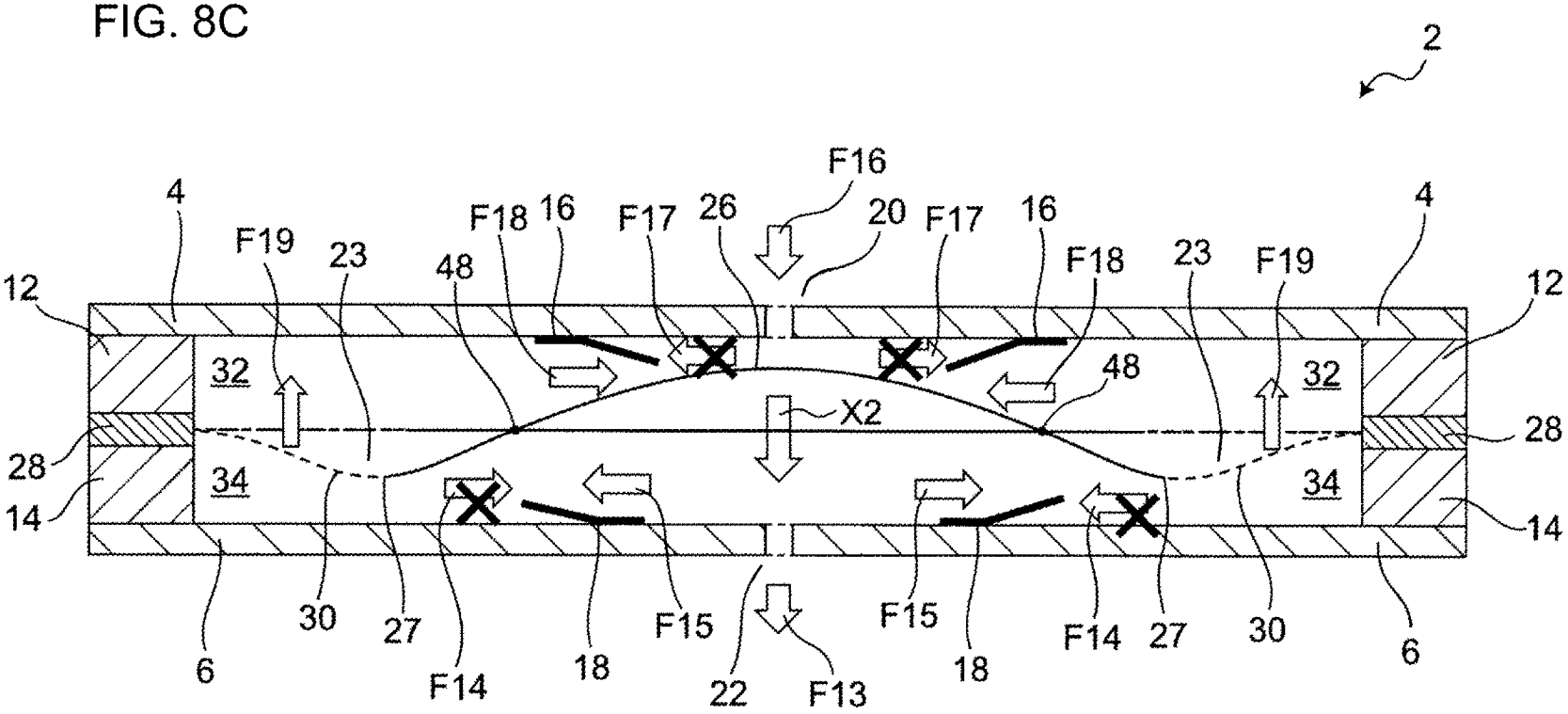
FIG. 8C is a sectional view of the piezoelectric pump according to Embodiment 1 and illustrates yet another state of operation thereof.
Figure 8D:
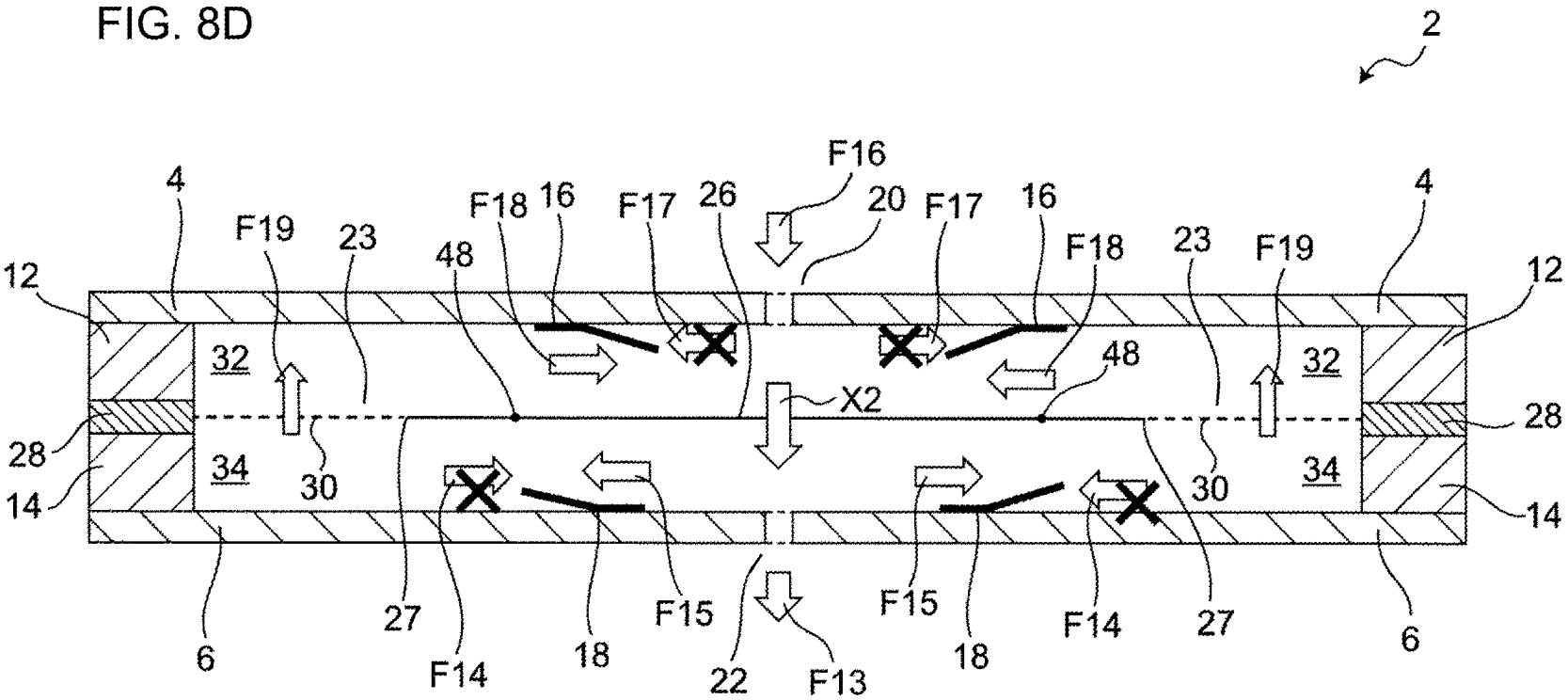
FIG. 8D is a sectional view of the piezoelectric pump according to Embodiment 1 and illustrates yet another state of operation thereof.

States subsequent to the state illustrated in FIG. 8B are illustrated in FIGS. 8C and 8D. FIG. 8C illustrates a state where the central part of the diaphragm 8 that has been in the state illustrated in FIG. 8B has moved most toward the first faceplate 4. FIG. 8D illustrates a state where the central part of the diaphragm 8 that has been in the state illustrated in FIG. 8C has moved toward the second faceplate 6 to become flat.

As illustrated in FIGS. 8C and 8D, when the central part of the diaphragm 8 that has been bent toward the first faceplate 4 moves toward the second faceplate 6 (see arrow X2), air in the central area of the second pump chamber 34 is pushed toward the second faceplate 6, whereby a current F13 discharged through the second opening 22 to the outside is generated. Meanwhile, the second valve 18 suppresses a current F14 flowing from the outer area toward the central area in the second pump chamber 34 but does not suppress a current F15 flowing from the central area toward the outer area in the second pump chamber 34. Since such a current F15 is promoted, the flow rate of the current F13 discharged through the second opening 22 to the outside is relatively reduced.

In the first pump chamber 32, the central area is expanded downward, whereby a negative pressure is generated. Therefore, a current F16 flowing from the outside of the piezoelectric pump 2 through the first opening 20 into the first pump chamber 32 is generated. Meanwhile, the first valve 16 suppresses a current F17 flowing from the central area toward the outer area in the first pump chamber 32 but does not suppress a current F18 flowing in the opposite direction in the first pump chamber 32 from the outer area toward the central area. Since such a current F18 is promoted, the flow rate of the current F16 flowing through the first opening 20 into the first pump chamber 32 is relatively reduced.

Since the currents F18 and F15 generated in the first pump chamber 32 and the second pump chamber 34, respectively, are promoted, a current F19 flowing from the second pump chamber 34 through the third openings 23 into the first pump chamber 32 is generated.

The series of states illustrated in FIGS. 8A to 8D are established repeatedly at a high speed in correspondence with the period of vibration of the piezoelectric device 10. The flow rates of the currents F6 and F9 illustrated in FIGS. 8A and 8B, which are controlled by the first valve 16 and the second valve 18, are greater than the flow rates of the currents F16 and F13 illustrated in FIGS. 8C and 8D. Therefore, average currents generated in the piezoelectric pump 2 are the currents F1 to F5 illustrated in FIG. 3. Specifically, the currents F1 to F5 are generated on average by the air that flows from the outside of the piezoelectric pump 2 through the second opening 22 into the second pump chamber 34, further flows from the second pump chamber 34 through the third openings 23 into the first pump chamber 32, and is discharged through the first opening 20 to the outside of the piezoelectric pump 2.

As illustrated in FIGS. 8A to 8D, the vibrating portion 26 has a vibration node 48. The vibration node 48 is a position where no displacement occurs while the vibrating portion 26 is vibrating. On the other hand, the outer edge 27 of the vibrating portion 26 is positioned apart from the vibration node 48. In such an arrangement, the outer edge 27 of the vibrating portion 26 can be made to vibrate assuredly. Therefore, excessive transmission of the vibration from the vibrating portion 26 through the connecting portions 30 to the frame portion 28 and the peripheral walls 12 and 14 can be suppressed. Consequently, the leakage of the vibrations of the piezoelectric device 10 and the vibrating portion 26 can be reduced.

In the piezoelectric pump 2 according to Embodiment 1 described above, the first valve 16 is provided at a distance from the first opening 20 in plan view as illustrated in FIG. 5A, and the second valve 18 is provided at a distance from the second opening 22 in plan view as illustrated in FIG. 5B. In such a configuration, since the first valve 16 and the second valve 18 are positioned apart from the first opening 20 and the second opening 22, respectively, the valves 16 and 18 do not collide with the edges of the openings 20 and 22. Therefore, the occurrence of the damage to the valves 16 and 18 can be suppressed. Consequently, the lives of the valves 16 and 18 can be extended, whereby the reliability of the piezoelectric pump 2 can be increased.

In the piezoelectric pump 2 according to Embodiment 1, the first valve 16 suppresses the air current flowing outward in plan view, and the second valve 18 suppresses the air current flowing inward in plan view. In such a configuration, the current F4 (see FIG. 3) flowing from the second pump chamber 34 through the third openings 23 into the first pump chamber 32 can be promoted. Therefore, the currents F1 to F5 illustrated in FIG. 3 can be generated on average.

In the piezoelectric pump 2 according to Embodiment 1, the first valve 16 includes the first fixed portion 16A fixed to the first faceplate 4, and the first movable portion 16B extending from the first fixed portion 16A. Furthermore, the second valve 18 includes the second fixed portion 18A fixed to the second faceplate 6, and the second movable portion 18B extending from the second fixed portion 18A. In such a configuration, since the valves 16 and 18 are fixed to the respective faceplates 4 and 6, the vibrations of the first fixed portion 16A of the valve 16 and the second fixed portion 18A of the second valve 18 can be made smaller than in a case where the valves 16 and 18 are fixed to the vibrating portion 26. Therefore, the occurrence of excessive vibration loss is suppressed, whereby a significant vibration displacement can be generated. Consequently, a high flow rate and improved pressure characteristics can be achieved.

In the piezoelectric pump 2 according to Embodiment 1, the first movable portion 16B of the first valve 16 is positioned on the inner side with respect to the first fixed portion 16A of the first valve 16 in plan view, and the second movable portion 18B of the second valve 18 is positioned on the outer side with respect to the second fixed portion 18A of the second valve 18 in plan view. In such a configuration, the current F4 flowing from the second pump chamber 34 through the third openings 23 into the first pump chamber 32 can be promoted. Therefore, the currents F1 to F5 illustrated in FIG. 3 can be generated on average.

In the piezoelectric pump 2 according to Embodiment 1, the vibrating portion 26, the frame portion 28, and the connecting portions 30 are integrated altogether. In such a configuration, the vibration of the vibrating portion 26 is less likely to be transmitted through the connecting portions 30 to the frame portion 28 than in a case where the diaphragm 8 is formed of a plurality of members. Therefore, the leakage of the vibration of the piezoelectric device 10 can be reduced.

In the piezoelectric pump 2 according to Embodiment 1, the piezoelectric device 10 in plan view overlaps the first opening 20 and a part of the first faceplate 4 around the first opening 20 and also overlaps the second opening 22 and a part of the second faceplate 6 around the second opening 22. In Embodiment 1 in particular, the first opening 20 and the second opening 22 are provided in the respective centers of the first pump chamber 32 and the second pump chamber 34 in plan view. In such a configuration, since the first opening 20 and the second opening 22 are provided at a position where the pressure change is significant, improved pressure characteristics can be achieved. Furthermore, since air can be discharged from an area where the pressure change is significant, air can be discharged at a high velocity.

(Modification)

While Embodiment 1 concerns a case where the diaphragm 8 includes the vibrating portion 26, the frame portion 28, and the connecting portions 30 that are integrated altogether, the present disclosure is not limited to such a case. A modification in which the diaphragm 8 includes a plurality of members will now be described with reference to FIG. 9.

Figure 9:
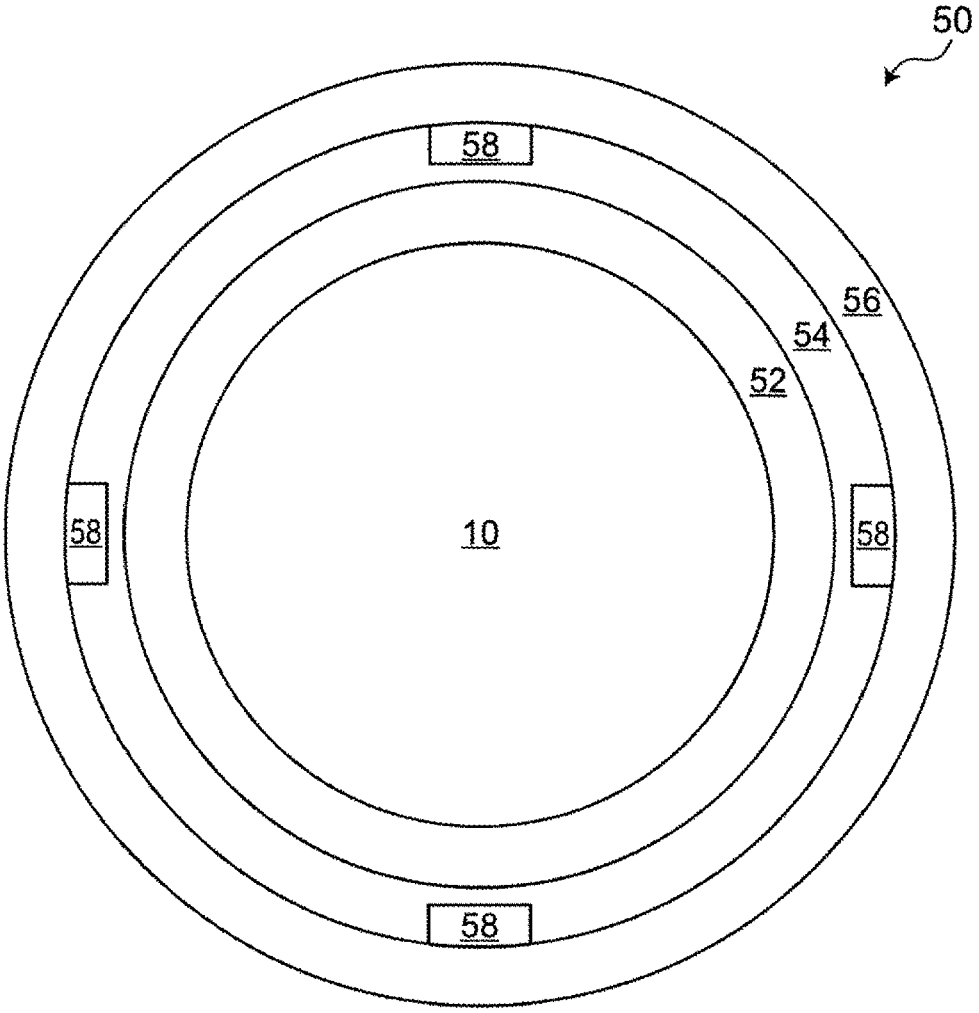
FIG. 9 is a plan view of a diaphragm according to a modification of Embodiment 1.

FIG. 9 is a plan view of a diaphragm 50 according to a modification. The diaphragm 50 illustrated in FIG. 9 includes a vibrating portion 52 to which the piezoelectric device 10 is attached, a connecting portion 54, and a frame portion 56. The vibrating portion 52, the connecting portion 54, and the frame portion 56 are separate from one another.

The vibrating portion 52, the connecting portion 54, and the frame portion 56 each have a substantially circular disc shape and are stacked in that order from above. The piezoelectric device 10 is placed on the vibrating portion 52, the vibrating portion 52 is placed on the connecting portion 54, and the connecting portion 54 is placed on the frame portion 56. The vibrating portion 52, the connecting portion 54, and the frame portion 56 are all positioned concentrically with the piezoelectric device 10.

As illustrated in FIG. 9, the outer periphery of the connecting portion 54 is cut in some parts, whereby a plurality of third openings 58 are provided. The third openings 58 allow the first pump chamber 32 and the second pump chamber 34 described above to communicate with each other. The frame portion 56, which adjoins the third openings 58, extends continuously over the entire circumference of the diaphragm 50. Therefore, the third openings 58 are not exposed to the outside of the piezoelectric pump 2.

The vibrating portion 52, the connecting portion 54, and the frame portion 56 forming the diaphragm 50 are separate from one another. That is, the diaphragm 50 can be made of a plural kinds of materials. Such a configuration increases the number of options for the material and shape of the diaphragm 50.

According to the present modification, the connecting portion 54 may be made of a material having an elastic modulus lower than that of the vibrating portion 52. In such a configuration, the vibration of the vibrating portion 52 is not likely to be transmitted through the connecting portion 54 to the frame portion 56. Therefore, the leakage of the vibration can be reduced. In such a case, the connecting portion 54 may be a film made of resin such as polyimide, PET, or PPS, and the vibrating portion 52 may be made of metal such as stainless steel or aluminum.

In the present modification, the connecting portion 54 may be thinner than the vibrating portion 52. In such a configuration, the vibration of the vibrating portion 52 is not likely to be transmitted through the connecting portion 54 to the frame portion 56. Therefore, the leakage of the vibration can be reduced further. In such a case, the connecting portion 54 may be made of metal foil with a thickness of about 0.01 to 0.2 mm, and the vibrating portion 52 may be made of a metal plate with a thickness of about 0.3 to 0.5 mm.

Embodiments 2 to 4

Piezoelectric pumps according to Embodiments 2 to 4 of the present disclosure will now be described. In Embodiments 2 to 4, differences from Embodiment 1 will be discussed mainly. Furthermore, the description already given in Embodiment 1 is omitted.

Figure 10:
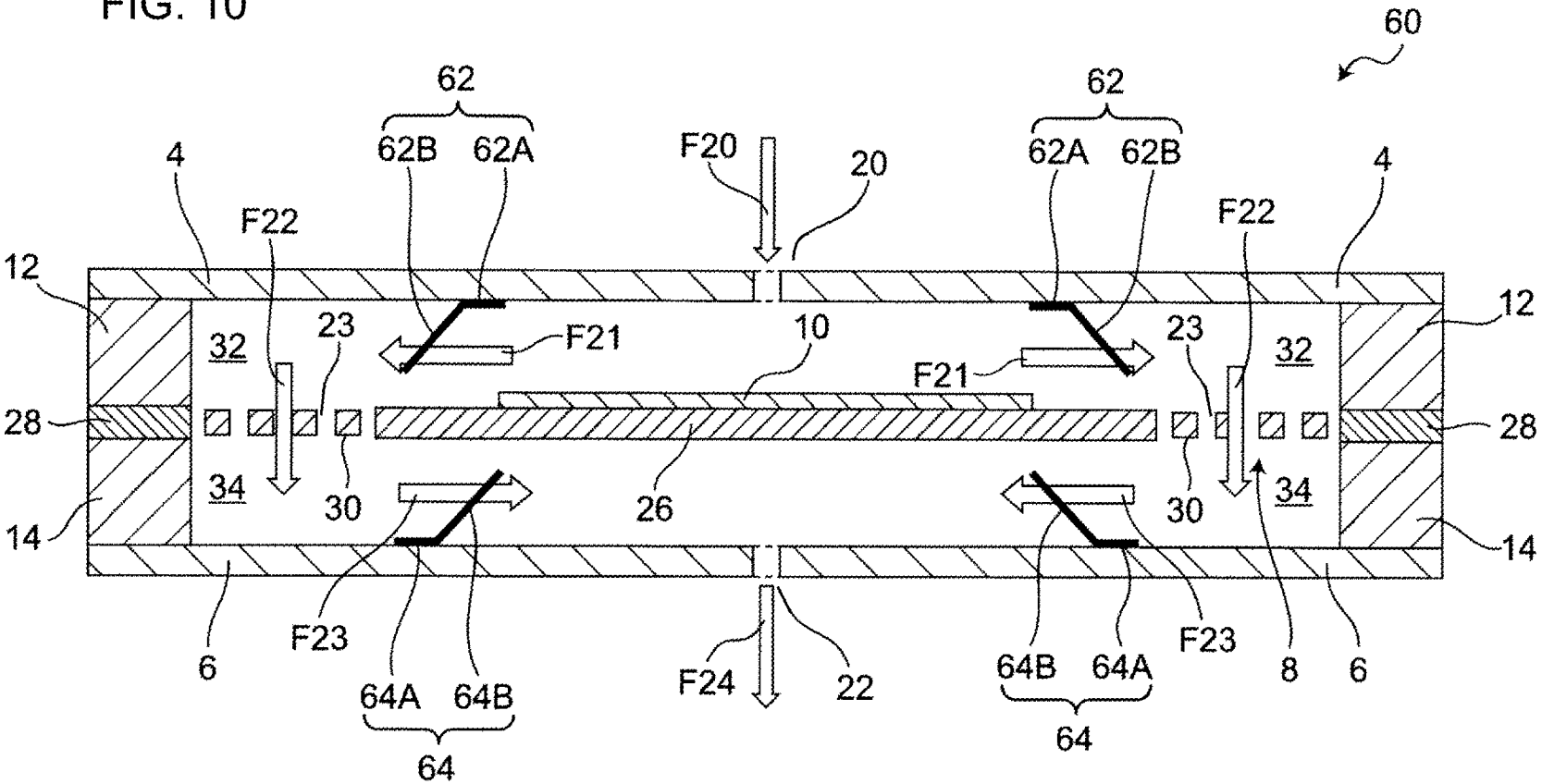
FIG. 10 is a sectional view of a piezoelectric pump according to Embodiment 2 and illustrates a schematic configuration thereof.
Figure 11:
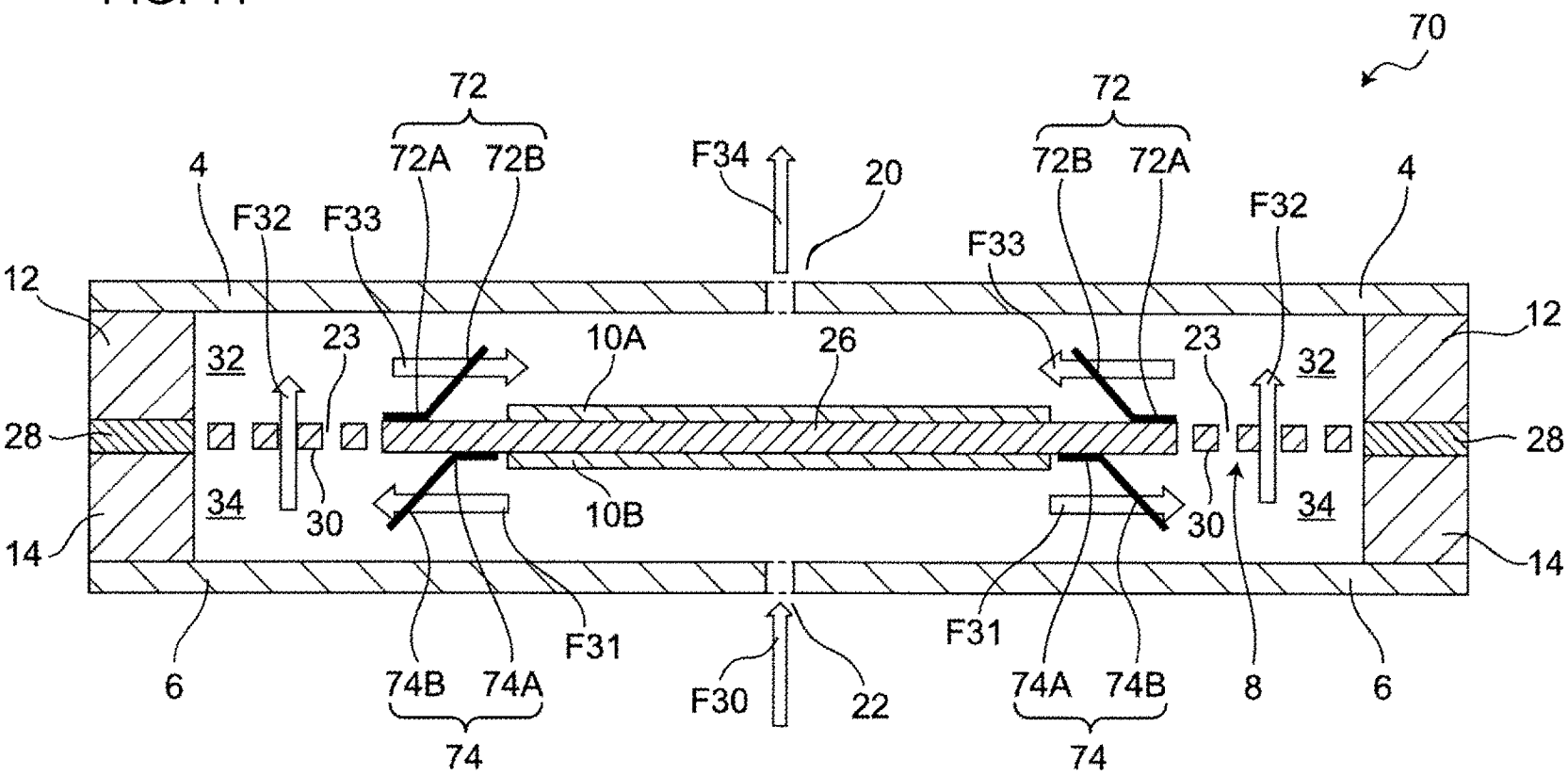
FIG. 11 is a sectional view of a piezoelectric pump according to Embodiment 3 and illustrates a schematic configuration thereof.
Figure 12:
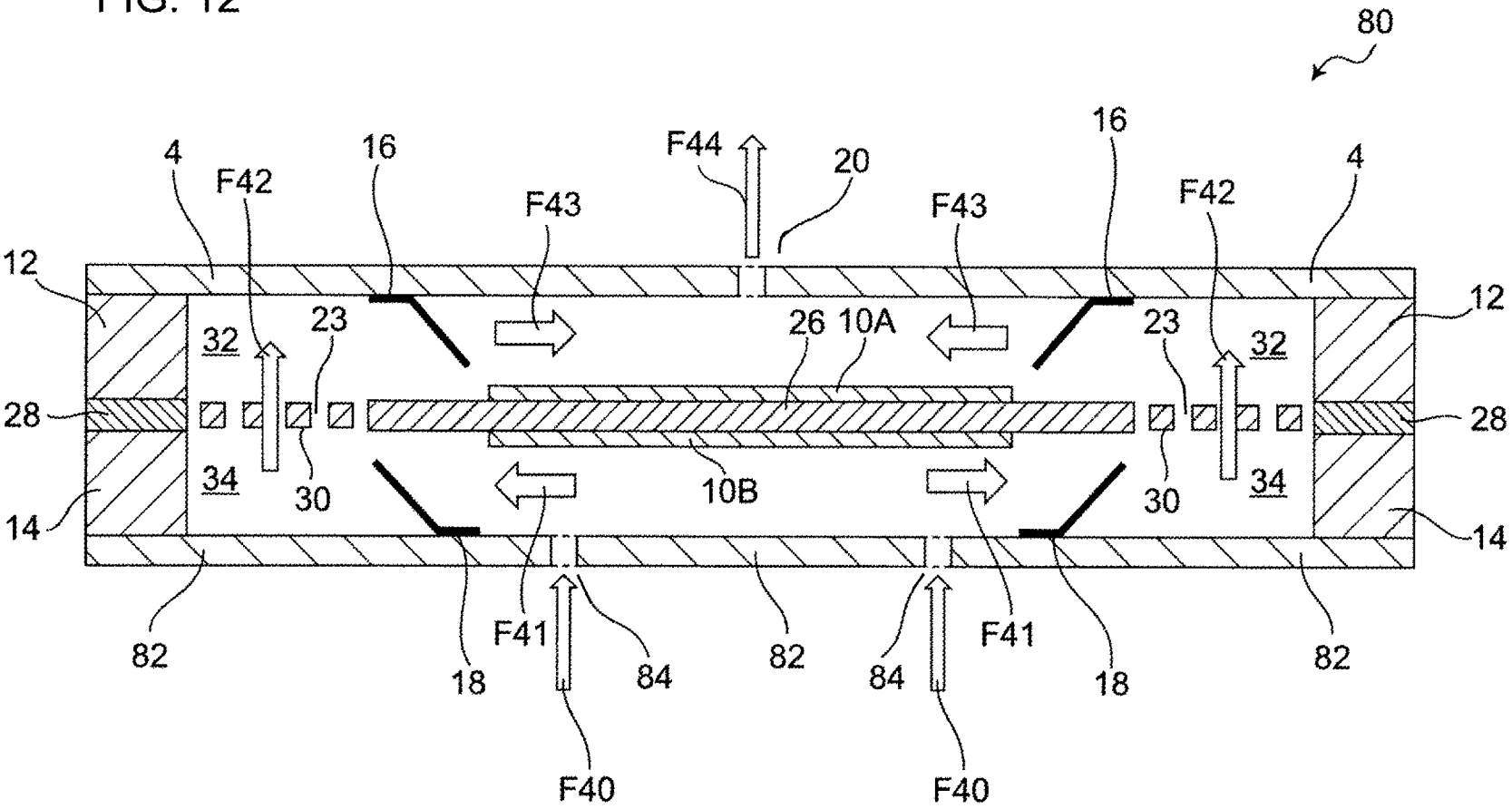
FIG. 12 is a sectional view of a piezoelectric pump according to Embodiment 4 and illustrates a schematic configuration thereof.

FIG. 10 is a vertical sectional view of a piezoelectric pump 60 according to Embodiment 2 and illustrates a schematic configuration thereof. FIG. 11 is a vertical sectional view of a piezoelectric pump 70 according to Embodiment 3 and illustrates a schematic configuration thereof. FIG. 12 is a vertical sectional view of a piezoelectric pump 80 according to Embodiment 4 and illustrates a schematic configuration thereof.

In Embodiments 2 to 4, factors such as the position and orientation of the first valve provided in the first pump chamber 32 and the position and orientation of the second valve provided in the second pump chamber 34 are different from those of Embodiment 1.

Embodiment 2

As illustrated in FIG. 10, the piezoelectric pump 60 according to Embodiment 2 includes a first valve 62 and a second valve 64. As with the case of Embodiment 1, the first valve 62 is fixed to the first faceplate 4, and the second valve 64 is fixed to the second faceplate 6. However, the positional relationship between the fixed portion and the movable portion of each of the valves 62 and 64 is different.

Specifically, the first valve 62 includes a first fixed portion 62A and a first movable portion 62B. The first movable portion 62B is positioned on the outer side with respect to the first fixed portion 62A in plan view. The second valve 64 includes a second fixed portion 64A and a second movable portion 64B. The second movable portion 64B is positioned on the inner side with respect to the second fixed portion 64A in plan view. That is, the first valve 62 suppresses an air current flowing inward in plan view, whereas the second valve 64 suppresses an air current flowing outward in plan view. In such a configuration, as illustrated in FIG. 10, currents F20 to F24 flowing in respective directions opposite to the directions of the currents generated in the piezoelectric pump 2 according to Embodiment 1 can be generated on average. Specifically, the currents F20 to F24 can be generated on average by the air that flows from the outside of the piezoelectric pump 2 through the first opening 20 into the first pump chamber 32, further flows from the first pump chamber 32 through the third openings 23 into the second pump chamber 34, and is discharged through the second opening 22 to the outside of the piezoelectric pump 2.

According to each of Embodiments 1 and 2, the first valve 16 or 62 suppresses the air current flowing inward or outward in plan view, whereas the second valve 18 or 64 suppresses the air current flowing in the direction opposite, in plan view, to the direction of the air current suppressed by the first valve 16 or 62. Thus, a current flowing from the outside through the second opening 22 to the inside and discharged through the first opening 20 to the outside, or a current flowing through the first opening 20 to the inside and discharged through the second opening 22 to the outside can be generated on average.

Embodiment 3

As illustrated in FIG. 11, the piezoelectric pump 70 according to Embodiment 3 includes a first valve 72 and a second valve 74. Unlike the case of Embodiment 1, the first valve 72 and the second valve 74 are both fixed to the vibrating portion 26 of the diaphragm 8. Furthermore, in the piezoelectric pump 70 according to Embodiment 3, piezoelectric devices 10A and 10B are pasted to the front and back faces, respectively, of the vibrating portion 26.

As illustrated in FIG. 11, the first valve 72 is fixed to the front face of the vibrating portion 26, and the second valve 74 is fixed to the back face of the vibrating portion 26. In the vibrating portion 26, the first valve 72 is attached to an area of the front face where the piezoelectric device 10A is absent, and the second valve 74 is attached to an area of the back face where the piezoelectric device 10B is absent.

As illustrated in FIG. 11, the first valve 72 includes a third fixed portion 72A and a third movable portion 72B. The third movable portion 72B is positioned on the inner side with respect to the third fixed portion 72A in plan view. The second valve 74 includes a fourth fixed portion 74A and a fourth movable portion 74B. The fourth movable portion 74B is positioned on the outer side with respect to the fourth fixed portion 74A in plan view. In such a configuration, currents F30 to F34 in respective directions that are the same as the directions of the currents generated in the piezoelectric pump 2 according to Embodiment 1 can be generated on average by the air flowing from the outside through the second opening 22 to the inside and discharged through the first opening 20 to the outside.

Since the valves 72 and 74 are both fixed to the vibrating portion 26 as described above, the flow-path resistance in areas in the piezoelectric pump 70 that are near the respective faceplates 4 and 6 can be reduced. Consequently, a high flow rate can be achieved.

Furthermore, since the two piezoelectric devices 10A and 10B generate a displacement greater than that generated in the case where only a single piezoelectric device 10 is provided, relevant characteristics can be improved. In addition, the vibrating portion 26 carrying the piezoelectric devices 10A and 10B as a whole has a vertically symmetrical shape. Therefore, the diaphragm 8 is not likely to warp with a temperature change, and relevant characteristics are stabilized.

Embodiment 4

As illustrated in FIG. 12, the piezoelectric pump 80 according to Embodiment 4 includes the first faceplate 4 with the first opening 20 having the same shape as that of Embodiment 1, and a second faceplate 82 with a second opening 84 having a different shape from that of Embodiment 1.

As illustrated in FIG. 12, the piezoelectric pump 80 according to Embodiment 4 includes the first valve 16 and the second valve 18 that are the same as those of the piezoelectric pump 2 according to Embodiment 1. Therefore, currents F40 to F44 are generated on average by the air that flows from the outside through the second opening 84 into the second pump chamber 34, further flows from the second pump chamber 34 through the third openings 23 into the first pump chamber 32, and is discharged from the first pump chamber 32 through the first opening 20 to the outside.

Here, the relationship between the second valve 18 and the second opening 84 in the piezoelectric pump 80 according to Embodiment 4 will be described with reference to FIG. 13.

Figure 13:
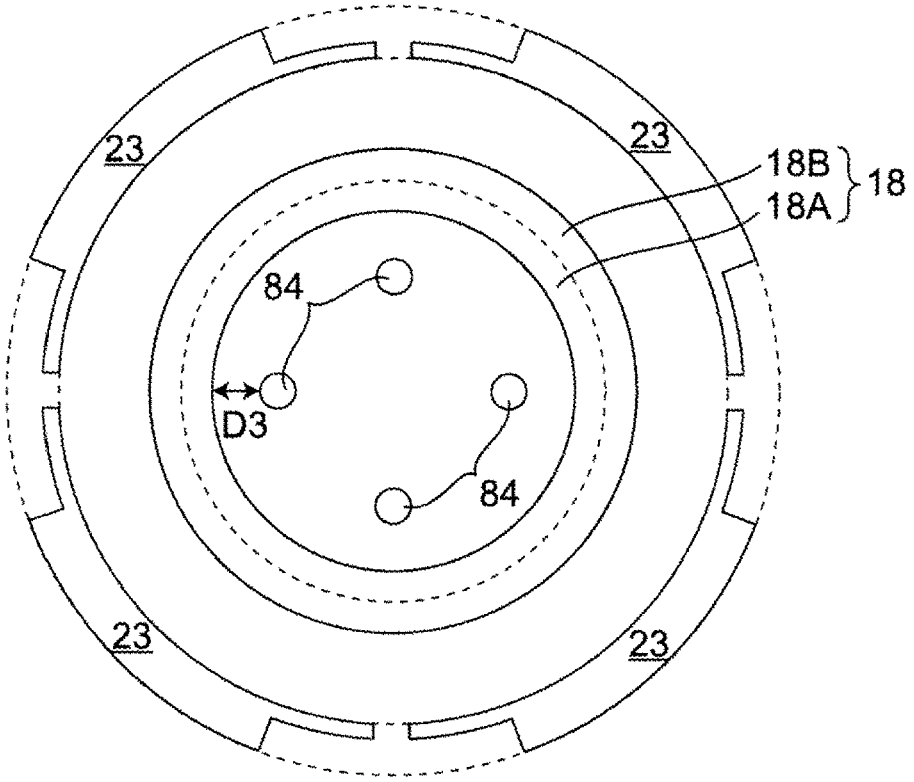
FIG. 13 is a plan view of the piezoelectric pump according to Embodiment 4 and illustrates the positional relationship between second openings, a second valve, and third openings.

FIG. 13 is a plan view of the piezoelectric pump 80 and illustrates the positional relationship between the second valve 18, the second opening 84, and the third openings 23.

As illustrated in FIG. 13, the second opening 84 includes a plurality of openings provided at separate positions, respectively. The plurality of second openings 84 are arranged on a virtual circle in plan view. The plurality of second openings 84 are all positioned on the inner side with respect to the second valve 18. The second valve 18 positioned on the outer side with respect to the second openings 84 has an annular shape surrounding the second openings 84 at a distance D3 therefrom.

Since the second valve 18 and the second openings 84 are at the distance D3 from each other in plan view, the second valve 18 does not collide with the edges of the second openings 84. Therefore, the occurrence of the damage to the second valve 18 can be suppressed, whereby the life of the second valve 18 can be extended. Consequently, the reliability of the piezoelectric pump 80 can be increased.

Furthermore, since there are a plurality of second openings 84, the flow-path resistance at each of the openings is reduced. Therefore, a high flow rate can be achieved.

While the present disclosure has been exemplified with Embodiments 1 to 4, the present disclosure is not limited to Embodiments 1 to 4 described above. For example, while Embodiment 1 concerns a case where the first valve 16 is provided in the first pump chamber 32 and the second valve 18 is provided in the second pump chamber 34, the present disclosure is not limited to such a case. Specifically, one of the first valve 16 and the second valve 18 may be omitted. That is, only a single valve may be provided in the piezoelectric pump 2. Alternatively, three or more valves may be provided in the piezoelectric pump 2.

The present disclosure provides full description of preferable embodiments with reference to the accompanying drawings, and various modifications and changes that can be made thereto are apparent to those skilled in the art. It should be understood that such modifications and changes made without departing from the scope of the present disclosure defined by the appended claims are within the scope of the present disclosure. Furthermore, the combination or order of elements described in any of the above embodiments may be changed without departing from the scope and spirit of the present disclosure.

The present disclosure is applicable to piezoelectric pumps including piezoelectric devices.

2 piezoelectric pump
4 first faceplate
6 second faceplate
8 diaphragm
10 piezoelectric device
12 first peripheral wall
14 second peripheral wall
16 first valve
16A fixed portion (first fixed portion)
16B movable portion (first movable portion)
18 second valve
18A fixed portion (second fixed portion)
18B movable portion (second movable portion)
20 first opening
22 second opening
23 third opening
26 vibrating portion
27 outer edge
28 frame portion
30 connecting portion
30A first connecting part
30B second connecting part
30C third connecting part
32 first pump chamber
34 second pump chamber
36 wire
38 first electrode
40 second electrode
42 insulating area
44 first wire
46 second wire
48 vibration node
50 diaphragm
52 vibrating portion
54 connecting portion
56 frame portion
58 third opening
60 piezoelectric pump
62 first valve
62A first fixed portion
62B first movable portion
64 second valve
64A second fixed portion
64B second movable portion
70 piezoelectric pump
72 first valve
72A third fixed portion
72B third movable portion
74 second valve

74A fourth fixed portion
74B fourth movable portion
80 piezoelectric pump
82 second faceplate
84 second opening
D1 to D3 distance
F1 to F19 current
F20 to F24 current
F30 to F34 current
F40 to F44 current
R circumferential direction
R1 segment extending toward one side
R2 segment extending toward an other side

The invention claimed is:

1. A piezoelectric pump comprising:

a first faceplate having a first opening;

a second faceplate spaced apart from the first faceplate and having a second opening;

a diaphragm provided between the first faceplate and the second faceplate and having a piezoelectric device attached thereto;

a first peripheral wall connecting the first faceplate and the diaphragm to each other and defining a first pump chamber between the first faceplate and the diaphragm; and a second peripheral wall connecting the second faceplate and the diaphragm to each other and defining a second pump chamber between the second faceplate and the diaphragm, wherein the diaphragm includes a vibrating portion having the piezoelectric device attached thereto; a frame portion held between the first peripheral wall and the second peripheral wall; and a connecting portion connecting the vibrating portion and the frame portion to each other, wherein the connecting portion defines a third opening, and the third opening communicates the first pump chamber with the second pump chamber, wherein the first pump chamber is provided with an annular first valve surrounding the first opening at a distance from the first opening in plan view, and wherein the first valve does not overlap the third opening in plan view.

2. The piezoelectric pump according to claim 1, wherein the second pump chamber is provided with an annular second valve surrounding the second opening at a distance from the second opening in plan, and wherein the first valve suppresses an air current flowing in a radially inward or outward direction in plan view, and the second valve suppresses an air current flowing in a direction opposite to the direction of the air current suppressed by the first valve in plan view.

3. The piezoelectric pump according to claim 2, wherein the first valve includes a first fixed portion fixed to the first faceplate; and a first movable portion extending from the first fixed portion, and wherein the second valve includes a second fixed portion fixed to the second faceplate;

and a second movable portion extending from the second fixed portion.

4. The piezoelectric pump according to claim 3, wherein the first movable portion of the first valve is positioned on an inner side with respect to the first fixed portion of the first valve in plan view, and wherein the second movable portion of the second valve is positioned on an outer side with respect to the second fixed portion of the second valve in plan view.

5. The piezoelectric pump according to claim 4, wherein an outer edge of the vibrating portion is positioned apart from a vibration node of the vibrating portion.

6. The piezoelectric pump according to claim 3, wherein the first movable portion of the first valve is positioned on an outer side with respect to the first fixed portion of the first valve in plan view, and wherein the second movable portion of the second valve is positioned on an inner side with respect to the second fixed portion of the second valve in plan view.

7. The piezoelectric pump according to claim 6, wherein an outer edge of the vibrating portion is positioned apart from a vibration node of the vibrating portion.

8. The piezoelectric pump according to claim 3, wherein an outer edge of the vibrating portion is positioned apart from a vibration node of the vibrating portion.

9. The piezoelectric pump according to claim 2, wherein an outer edge of the vibrating portion is positioned apart from a vibration node of the vibrating portion.

10. The piezoelectric pump according to claim 1, wherein an outer edge of the vibrating portion is positioned apart from a vibration node of the vibrating portion.

11. The piezoelectric pump according to claim 1, wherein the vibrating portion, the connecting portion, and the frame portion are integrated altogether.

12. The piezoelectric pump according to claim 1, wherein the vibrating portion and the connecting portion are separate from each other, and the connecting portion comprises a material having an elastic modulus lower than an elastic modulus of the vibrating portion.

13. The piezoelectric pump according to claim 12, wherein the connecting portion is thinner than the vibrating portion.

14. The piezoelectric pump according to claim 1, wherein the connecting portion includes a first connecting part extending outward from an outer edge of the vibrating portion; a second connecting part extending from the first connecting part and along the outer edge of the vibrating portion; and a third connecting part extending from the second connecting part and connected to the frame portion.

15. A piezoelectric pump comprising:

a first faceplate having a first opening;

a second faceplate spaced apart from the first faceplate and having a second opening;

a diaphragm provided between the first faceplate and the second faceplate and having a piezoelectric device attached thereto;

a first peripheral wall connecting the first faceplate and the diaphragm to each other and defining a first pump chamber between the first faceplate and the diaphragm; and a second peripheral wall connecting the second faceplate and the diaphragm to each other and defining a second pump chamber between the second faceplate and the diaphragm, wherein the diaphragm includes a vibrating portion having the piezoelectric device attached thereto; a frame portion held between the first peripheral wall and the second peripheral wall; and a connecting portion connecting the vibrating portion and the frame portion to each other, wherein the connecting portion defines a third opening, and the third opening communicates the first pump chamber with the second pump chamber, wherein the first pump chamber is provided with an annular first valve surrounding the first opening at a distance from the first opening in plan view, wherein the second pump chamber is provided with an annular second valve surrounding the second opening at a distance from the second opening in plan view, wherein the first valve includes a third fixed portion fixed to the vibrating portion; and a third movable portion extending from the third fixed portion, and wherein the second valve includes a fourth fixed portion fixed to the vibrating portion;

and a fourth movable portion extending from the fourth fixed portion.

16. The piezoelectric pump according to claim 15, wherein the third movable portion of the first valve is positioned on an inner side with respect to the third fixed portion of the first valve in plan view, and wherein the fourth movable portion of the second valve is positioned on an outer side with respect to the fourth fixed portion of the second valve in plan view from the major surface of the second faceplate toward the major surface of the diaphragm.

17. The piezoelectric pump according to claim 16, wherein an outer edge of the vibrating portion is positioned apart from a vibration node of the vibrating portion.

18. The piezoelectric pump according to claim 4, wherein an outer edge of the vibrating portion is positioned apart from a vibration node of the vibrating portion.

19. The piezoelectric pump according to claim 15, wherein the third movable portion of the first valve is positioned on an outer side with respect to the third fixed portion of the first valve in plan view, and wherein the fourth movable portion of the second valve is positioned on an inner side with respect to the fourth fixed portion of the second valve in plan view.

20. The piezoelectric pump according to claim 19, wherein an outer edge of the vibrating portion is positioned apart from a vibration node of the vibrating portion.

21. A piezoelectric pump comprising:

a first faceplate having a first opening;

a second faceplate spaced apart from the first faceplate and having a second opening;

a diaphragm provided between the first faceplate and the second faceplate and having a piezoelectric device attached thereto;

a first peripheral wall connecting the first faceplate and the diaphragm to each other and defining a first pump chamber between the first faceplate and the diaphragm; and a second peripheral wall connecting the second faceplate and the diaphragm to each other and defining a second pump chamber between the second faceplate and the diaphragm, wherein the diaphragm includes a vibrating portion having the piezoelectric device attached thereto; a frame portion held between the first peripheral wall and the second peripheral wall; and a connecting portion connecting the vibrating portion and the frame portion to each other, wherein the connecting portion defines a third opening, and the third opening communicates the first pump chamber with the second pump chamber, wherein the first pump chamber is provided with an annular first valve surrounding the first opening at a distance from the first opening in plan view, and wherein the first valve is fixed to the first faceplate.

* * * * *